US005761772A

United States Patent [19]

Clapp et al.

[11] Patent Number: 5,761,772

[45] Date of Patent: Jun. 9, 1998

[54] SECURING AND PRESSURING SYSTEM FOR DRAFTING ROLLERS FOR AUTOMATED TEXTILE DRAFTING SYSTEM

[75] Inventors: Timothy G. Clapp, New Hill; Jon P. Rust, Raleigh, both of N.C.; Carlos Farrington, Guatemala, Guatemala; Dale Thomas Bowen, Timberlake, N.C.; Roger Neil Saunders, Yadkinville, N.C.; Matthew Myers Thomas, Lewisville, N.C.

[73] Assignee: North Carolina State University, Raleigh, N.C.

[21] Appl. No.: 684,037

[22] Filed: Jul. 19, 1996

[51] Int. Cl.[6] ..... D01H 5/74

[52] U.S. Cl. ..... 19/260; 19/272

[58] Field of Search ..... 19/236, 260, 266, 19/271, 272, 267, 268, 273, 278, 261

[56] References Cited

U.S. PATENT DOCUMENTS

| | | | |
|---|---|---|---|
| 4,187,587 | 2/1980 | Vignon | 19/272 |
| 4,510,648 | 4/1985 | Mori et al. | 19/266 |
| 4,999,884 | 3/1991 | Vignon | 19/266 |
| 5,177,835 | 1/1993 | Ogawa et al. | 19/260 |

FOREIGN PATENT DOCUMENTS

| | | | |
|---|---|---|---|
| 1325219 | 5/1962 | France | 19/272 |
| 693252 | 6/1953 | United Kingdom | 19/272 |
| 821443 | 10/1959 | United Kingdom | 19/272 |
| 873253 | 7/1961 | United Kingdom | 19/272 |

*Primary Examiner*—Michael A. Neas
*Attorney, Agent, or Firm*—Jenkins & Wilson, P.A.

[57] ABSTRACT

An automated drafting system particularly suitable for drafting textile strands of sliver is provided. The automated drafting system includes a synchronous drive sliver drafting roller system utilizing toothed gears in the preferred embodiment operatively connecting a pair of drafting rollers with one of the rollers being directly driven by a motor to thereby cause identical rotation of both rollers. The automated drafting system also includes a system for securing and pressuring together upper and lower sliver drafting rollers wherein the lower roller of a pair of drafting rollers is preferably maintained in a fixed but rotational position while the upper roller of the pair is pressured towards the lower roller and controllably restricted as to both horizontal and vertical movement during the drafting process. A sliver autoleveling system using tongue and groove drafting rollers to sense sliver uniformity is also included in the automated drafting system utilizing linear variable differential transformers (LVDTs) to monitor vertical displacement of the upper roller of a roller pair relative to the lower roller. The automated drafting system further provides a feed-forward and feed-back autoleveling system for control of sliver drafting rollers utilizing an input sliver sensor and an output sliver sensor communicating with a computer to facilitate sliver uniformity. A draftless sliver coiler packaging system is still further provided by the automated drafting system and utilizes a sliver level sensor to controllably and automatically adjust the speed at which sliver is packaged subsequent to emergence from a variable speed sliver delivery system.

7 Claims, 23 Drawing Sheets

SECURING AND PRESSURING SYSTEM FOR DRAFTING ROLLERS FOR AUTOMATED TEXTILE DRAFTING SYSTEM

TECHNICAL FIELD

The present invention relates generally to a textile fiber strand drafting system. More particularly, the present invention relates to a novel automated drafting system for textile strands utilizing a novel synchronous drive sliver drafting roller system, a novel system for securing and pressuring sliver drafting rollers, a novel sliver autoleveling system using tongue and groove drafting rollers as sliver uniformity sensing means, a novel feed-forward and feed-back autoleveling system for control of sliver drafting rollers, and a novel draftless sliver coiler packaging system.

RELATED ART

The use of cooperating rollers to draft a strand of material therebetween has widespread industrial applications. In particular, the drafting of textile fiber strands (also called "sliver") utilizing a plurality of pairs of upper and lower drafting rollers is well known in the textile art. The upper and lower rollers of a given pair of rollers are typically pressed together to grip a textile strand passing therebetween as the rollers rotate so as to impart a common surface velocity to advance the textile strand therebetween. As is well known in the art, the pairs of rollers typically are arranged along the textile fiber strand pathway such that the peripheral speed of each pair of successive rollers is greater than that of the preceding pair of rollers. This successive increase in surface velocity of the rollers results in the elongation and thinning of a textile strand passing therebetween. This process of continuous elongation is commonly referred to in the art as "drawing" or "drafting" depending upon the particular area where the process is utilized.

In prior art drafting systems, the rollers within a given pair of rollers are in friction contact with one another as they press against each other. It is extremely important in drafting a textile fiber strand that the upper and lower rollers within a given pair move with precisely the same surface velocity since any differences in their velocities can generate a fiber shift and potentially cause damage to the uniformity of the textile fiber strand passing therebetween. Typically, the upper roller in a pair of conventional drafting rollers is rubber-coated (COT covered) and the bottom roller of the pair is a fluted, metal roller, and a locking mechanism is utilized to secure the upper roller in contact against the bottom roller. The lower, metal roller is typically the only roller driven, and the friction between the lower roller and the upper roller actually drives the upper roller such that the surface velocities of the two rollers are the same.

In many of the prior art sliver drafting systems, pressure is applied by the use of springs to the top and/or bottom drafting rollers to urge them together. Inherent problems resulting from the use of springs are that they age and fatigue, their constants change with time and their constants are usually a little different from one spring to another. As such, there is no way to accurately insure a constant and precise pressuring of spring-pressured drafting rollers at any given time. As thicker textile strand material is passed between drafting rollers, the roller displacement might change slightly, but the aging of the springs utilized can also cause the amount of pressure or force applied by the springs to the rollers to change, thus requiring frequent monitoring to prevent damage to the fiber strand and/or to the uniformity of the fiber strand.

One system, called the PK 6000, manufactured by SKF of Stuttgart, Germany, does not utilize a spring for applying pressure to drafting rollers, but rather, utilizes pneumatics for applying pressure to drafting rollers. More specifically, the PK 6000 system utilizes pneumatic pressure to apply force to drafting rollers on a spinning frame for spinning long, staple, worsted yarns. This system is well-known to those skilled in the textile art.

As is also known to those skilled in the textile art, the mass per unit length of a textile fiber strand can be referred to as its "linear density". A textile strand of sliver does not have a perfectly uniform linear density, and fluctuations in the linear density of sliver cause what can be referred to as "thick" and "thin" places along the sliver. Such fluctuations can usually be seen in the product, such as yarn, produced from the sliver and can result in visual defects in fabric produced from such yarn. As a result, it has been desirable since the earliest days of the industrialized textile industry to keep fluctuations in the linear density of the sliver to a minimum.

Some of the prior art drafting systems act as "autoleveling" systems which continuously monitor the linear density of a textile sliver strand with a view to controlling the linear density by controlling the relative velocities of various pairs of rollers. Autoleveling systems utilize the drafting rollers of a drafting system to attenuate or reduce heavy or thick areas of sliver where such attenuation is needed, and they refrain from such attenuation or reduction of the sliver in thin areas thereof in order to make a more uniform sliver in terms of linear density.

In conventional drafting systems which are autoleveling, the thickness of the sliver is typically sensed in advance of the drafting zone to produce an input signal, and this signal is commonly used along with a delay since by necessity there is some delay between the sensing location and the location where drafting actually occurs. These types of autoleveling systems can be referred to as "feed-forward" autoleveling since the textile sliver is fed forward from the sensing location with a delay for subsequent roller drafting. One example of a conventional feed-forward autoleveling roller drafting system with a delay is disclosed in U.S. Pat. No. 5,018,248 to Haworth et al.

Another conventional type of autoleveling system used in sliver drafting is commonly referred to as "feed-back" autoleveling. In this type of system, the output of a roller drafting zone is monitored over a long period of time, and attempts are made to correct for long term linear density variations of the sliver by measuring the weight of the sliver over a long period of time and making changes infrequently. Feed-back autoleveling is very different from feed-forward autoleveling in that with feed-forward autoleveling, changes in the speed of the rollers are made very frequently in order to adjust for short term and intermediate term uniformity defects in the sliver and in order to attempt to make short term corrections to the sliver uniformity. Quite distinguishably, feed-back autoleveling systems typically only make very long term corrections to the average sliver weight.

A device which has been used in prior art textile sliver drafting systems to continuously monitor the separation of upper and lower rollers is a linear variable differential transformer (LVDT). Prior art drafting systems utilizing LVDTs to date have only used cylindrical rollers therewith. For example, U.S. Pat. No. 5,010,494 to Lord, which is assigned to the assignee of the present invention, discloses a method and apparatus for detecting mechanical drafting roll imperfections in a roller drafting system utilizing LVDTs of conventional design. The LVDTs are used with their movable armatures contacting the shaft or bearings at one or both ends of the upper drafting roller of each set of rollers such that the LVDTs are able to sense the vertical or nearly vertical movement of the top drafting rollers of each system of drafting rollers with great accuracy. The LVDTs associated with each upper roller provide an electrical or other signal representative of the separation between the associated vertically movable upper and fixed lower rollers.

While some drafting systems utilize rollers that are entirely cylindrical along their lengths, other drafting systems utilize tongue and groove type rollers which have inherent advantages that are well known in the textile art. A primary advantage of tongue and groove rollers is that they are able to exert a more uniform pressure on the fibers in a textile strand of sliver during the drafting process so as to result in a more uniform drafted strand. U.S. Pat. No. 4,768,262 to Gunter discusses some of the advantages inherent in using tongue and groove rollers and discloses an apparatus and method for textile strand drafting utilizing tongue and groove drafting rollers which are pressed against one another and friction driven. Additionally, U.S. Pat. Nos. 5,018,248 and 5,339,495, to Haworth et al. both disclose the use of tongue and groove rollers as a sensing device in an autoleveling drafting system. Other representative examples of the tongue and groove rollers in drafting systems can be seen in U.S. Pat. Nos. 4,551,887 to Murata and 4,489,461 to Toyoda.

As is also well known in the art, processed sliver passing out of a drafting system in a textile manufacturing facility is typically packaged or coiled into a large can. A packaging device utilized to collect sliver passing from a drafting system typically runs at a constant speed since the sliver is normally delivered at a constant speed from the drafting system. Sliver packaging devices do exist, however, for coiling sliver passing from a drafting system at a variable rate. (See, for example, U.S. Pat. Nos. 5,161,284 and 5,274,884.)

In traditional sliver packaging systems, a direct mechanical linkage usually exists between the textile sliver strand production system or device and the sliver packaging device causing operation of the sliver packaging device to be dependent upon the sliver production device. Traditional sliver packaging devices also require contact between the sliver and the components of the packaging system wherein such contact has the potential for damaging the sliver and/or the uniformity of the sliver between the sliver production device and the sliver packaging device. U.S. Pat. No. 5,339,495 to Haworth et al. provides one example of a coiler device for use with an autoleveling drafting system.

Even with recent improvements in sliver drafting technology, there remains much room for improvement in the art of automated drafting systems for textile sliver strands, particularly for such an automated drafting system which can impart a high degree of linear density uniformity to a textile sliver strand during the drafting process. Applicants have discovered such an automated sliver drafting system that provides excellent uniformity in the linear density of the processed sliver strand that is unexpected and surprising to one skilled in the textile art for a sliver strand that has not been subjected to conventional drawing apparatus.

DISCLOSURE OF THE INVENTION

In accordance with the present invention, a novel automated drafting system is provided for drafting a strand of material between drafting rollers. In particular, this invention provides an automated drafting system for textile strands which can be used to impart a high degree of uniformity to a textile strand during the drafting process. While the description provided herein pertains particularly to the drafting of a textile fiber strand, such description is not intended to limit the scope and application of this invention as it is contemplated that the automated drafting system provided by this invention can be used with the drafting of other suitable strand materials.

The automated drafting system of this invention includes a novel synchronous drive sliver drafting roller system whereby a pair of drafting rollers are mechanically connected such that rotation of one of the rollers causes simultaneous and identical rotation of the other of the rollers. In the preferred embodiment, toothed gears are utilized to operatively connect each of the rollers, and a motor drives the lower roller directly, and therefore, the upper roller indirectly.

The automated drafting system of this invention also includes a novel system for securing and urging together sliver drafting rollers. In the preferred embodiment, the lower roller of a pair of drafting rollers is maintained in a fixed position within a frame whereby only rotational movement of the lower roller is allowed. The upper roller of the pair is preferably maintained in a separate frame for movably cooperating with the frame of the lower roller such that the upper roller is movable only vertically toward and away from the lower roller. Adjustable movement means is utilized for moving the upper roller and its corresponding frame toward and into pressurized contact with the lower roller, and away from the lower roller.

In the preferred embodiment, the adjustable movement means comprises a plurality of pneumatic cylinders fixedly attached to the frame of the lower roller. The pneumatic cylinders are in a retracted position with the upper roller being urged close to or even into contact with the lower roller in a normal drafting position, and the pneumatic cylinders can be moved to an extended position wherein the upper and lower rollers are vertically separated from one another in a non-operational drafting position. The frame of the upper roller includes an upper portion comprising the upper roller which is slidably attachable and removable from a remainder of the frame. A portion of the frames of both the upper and lower rollers are receivably engagable when the upper and lower rollers are in an operational position with the cylinders retracted such that the upper portion of the frame of the upper roller cannot be slidably removed from a remainder of the frame of the upper roller.

The automated drafting of this invention also includes a novel sliver autoleveling system using tongue and groove drafting rollers as sliver uniformity sensing means. A given pair of drafting rollers are therefore tongue and groove-type rollers, and in the preferred embodiment, each upper roller of a pair comprises the tongue while each lower roller of a pair comprises the groove. One or more linear variable differential transformers (LVDTs) are utilized in association with the upper roller of each pair of rollers and operatively associated with a computer to monitor vertical displacement of each upper roller away from a corresponding lower roller to detect and monitor sliver uniformity variances.

The automated drafting system of this invention also provides a novel feed-forward and feed-back autoleveling system for control of the sliver drafting rollers. An input sliver sensor is utilized to measure and monitor the linear density of sliver either prior to or as the sliver passes through the first pair of drafting rollers during the drafting process. An output sliver sensor is utilized to measure and monitor the linear density of sliver either subsequent to or as the sliver passes through the last pair of drafting rollers of the sliver drafting process. Signals from the input sliver sensor are processed through a computer and utilized in a feed-forward manner to make short-term and intermediate changes or corrections in drafting of the sliver. Signals from the output sliver sensor are processed through the computer and utilized in a feed-back manner to make long-term changes or corrections in the drafting of sliver. One or more LVDTs associated with the upper roller of the first and last pairs of drafting rollers (as discussed hereinbefore with respect to the novel autoleveling system) or any other suitable sensor means can be utilized for the input sliver sensor and the output sliver sensor.

Finally, the automated drafting system of this invention also includes a novel draftless sliver coiler packaging system. A non-contact sliver level sensor is utilized to detect the level of a loop of sliver as the sliver passes to a packaging device such as a coiler can. In the preferred embodiment, the sliver level sensor comprises a plurality of photodiodes. The sliver level sensor communicates with a computer such that the height (or tautness) of the sliver strand can be detected and the rate at which the sliver is packaged can be automatically adjusted to accommodate the linear speed at which sliver emerges from a sliver delivery system.

Therefore, it is a primary object of the present invention to provide a novel automated drafting system for textile strands which imparts a higher degree of linear density uniformity to a textile strand without utilizing conventional drawing apparatus than has been possible heretofore.

It is another object of the present invention to provide a novel synchronous drive sliver drafting roller system.

It is a further object of the present invention to provide a novel system for securing and urging together upper and lower sliver drafting rollers.

It is a further object of the present invention to provide a novel sliver autoleveling system using tongue and groove drafting rollers as sliver uniformity sensing means.

It is a further object of the present invention to provide a novel feed-forward and feed-back autoleveling system for control of sliver drafting rollers.

It is a further object of the present invention to provide a novel draftless sliver coiler packaging system.

It is a further object of the present invention to provide a novel automated drafting system that produces a more uniform drafted sliver than has heretofore been possible without utilizing conventional drawing apparatus and that in turn produces higher quality yarns and fabrics.

Some of the objects of the invention having been stated, other objects will become evident as the description proceeds, when taken in connection with the accompanying drawings.

BEST MODE FOR CARRYING OUT THE INVENTION

Figure 1:
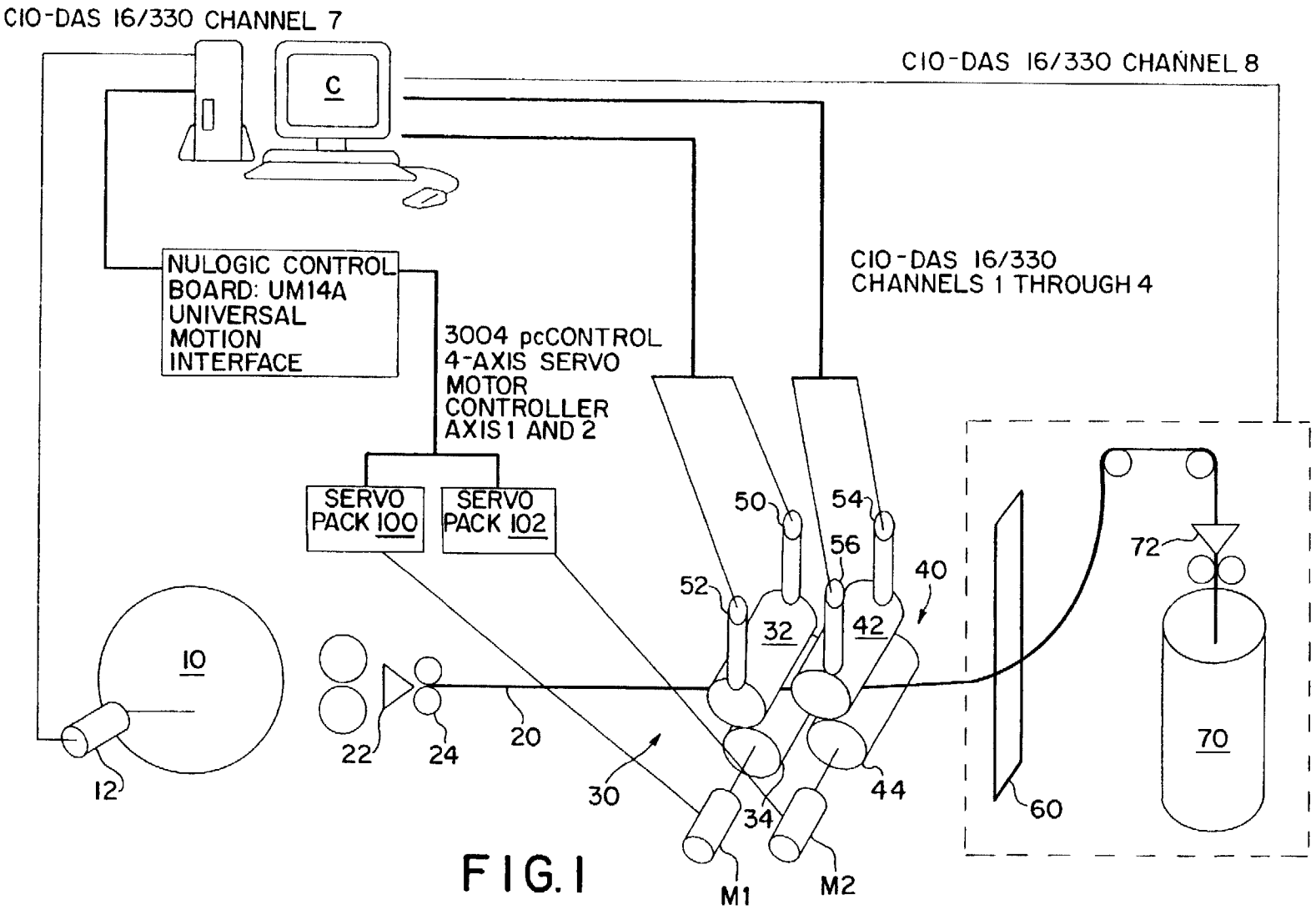
FIG. 1 is a schematic illustration of the entire integrated automated drafting system for textile strands of the invention including all five (5) novel drafting innovations described herein.

The present invention provides a novel automated drafting system for textile strands capable of imparting a high degree of uniformity to a textile strand without utilizing conventional drawing apparatus. The automated drafting system in accordance with this invention incorporates five (5) novel features comprising: (1) a novel synchronous drive sliver drafting roller system; (2) a novel system for securing and pressuring together the upper and lower sliver drafting rollers; (3) a novel sliver autoleveling system using tongue and groove drafting rollers as sliver uniformity sensing means; (4) a novel feed-forward and feed-back autoleveling system for control of sliver drafting rollers; and (5) a novel draftless sliver coiler packaging system. FIG. 1 of the drawings is a schematic illustration of the automated drafting system according to this invention and generally illustrates the above-identified novel systems of the automated drafting system.

OVERVIEW OF AUTOMATED DRAFTING SYSTEM INVENTION

As illustrated in FIG. 1, the automated drafting system of this invention is controlled by computer C, which can be an Advanced Logic Research brand Model Evolution V ST. Computer C is preferably provided with an analog-to-digital (A/D) card (described hereinafter) to convert incoming sensor signals to digital arrays in order that filtering and digital signal processing can occur whereby digital signals can be used to control the drafting system as discussed further hereinbelow. A card having a card doffer roll 10 of conventional design is utilized as known in the textile art to provide textile fiber in the form of a web on card doffer roll 10. A sensor comprising tach generator 12 on card doffer roll 10 communicates with computer C and precisely measures the speed of card doffer roll 10. Tach generator 12 can be a 7.0/1000 rpm tach generator Model Number SN-763A-2 commercially available from Servo-Tek Products Company of Hawthorne, N.J.

The web of fiber is removed from card doffer roll 10 and immediately condensed down into a sliver 20, which is a rope-like strand of generally parallel textile fibers. Tach generator 12 enables the speed of card doffer 10 to be monitored so that the speed of production of sliver can be desirably controlled, as discussed hereinbelow. The web passes through condensing trumpet 22 and sliver 20 formed thereby then passes through calendar rolls 24 where sliver 20 is actually further condensed, pressed together and pinched between calendar rolls 24. A card trumpet sensor (not shown) communicates with computer C and can be used at trumpet 22 to sense the thickness or mass of sliver 20 along its length. From calendar rolls 24, sliver 20 passes to the area or zone where sliver 20 will actually be drafted by the automated drafting system according to this invention.

Drafting of sliver according to the present invention is accomplished by passing sliver 20 through a plurality of pairs of drafting rollers 32, 34 and 42, 44 wherein the pairs of drafting rollers attenuate the sliver between each pair of drafting rollers. Although FIG. 1 illustrates two pairs of drafting rollers 32, 34, and 42, 44 as used in the preferred embodiment, it is contemplated according to this invention that more than two pairs of drafting rollers can also be utilized for drafting of sliver 20.

While the particular structure of the drafting system according to this invention will be described in further detail hereinbelow, FIG. 1 illustrates generally the drafting rollers as they comprise two pairs of drafting rollers including back rollers generally designated 30 and front rollers generally designated 40. Each of the pairs of drafting rollers includes both an upper roller and a lower roller. For example, back roller pair 30 include upper roller 32 and lower roller 34, and front roller pair 40 include upper roller 42 and lower roller 44. The lower rollers, rollers 34 and 44, of each pair of rollers 30 and 40, respectively, are driven by motors M1 and M2, respectively, which electrically communicate with computer C.

In addition to components for control of motors M1 and M2 as described hereinbelow, computer C preferably comprises a D/A Board, such as Model Number CIO-DDA06/12, and an A/D Board, such as Model Number CIO-DAS16/330, both commercially available from ComputerBoards, Inc. of Mansfield, Mass. An I/O Board such as Model Number PIO-32 commercially available from Keithley Metrabyte of Taunton, Mass. is also preferably included with computer C.

Linear variable differential transformers (LVDTs), 50, 52, and 54, 56, are utilized in operative association with upper rollers 32 and 42, respectively, to monitor the separation, typically vertical movement, of the upper rollers. In this manner, the LVDTs continuously measure the thickness or mass of sliver 20 passing between upper rollers 32 and 42 and lower rollers 34 and 44, respectively. This data is used by computer C in determining whether a particular section of sliver needs more or less draft. Sliver 20 is introduced to the drafting system between back rollers 30, passing therebetween and to and between front rollers 40. After emerging from front rollers 40, sliver 20 passes to the draftless sliver coiler packaging system of this invention which comprises sliver level sensor 60 which can communicate with computer C (see FIG. 22) and can be used to control the speed at which the sliver is taken from front rollers 40 and packaged into coiler can 70.

The signal from tach generator 12 can be used to control the speed of back drafting rollers 30. The speed of back rollers 30 along with the information obtained from card trumpet sensor 26 (not shown) or LVDTs 50, 52 associated with back rollers 30 can be used to control the speed of front drafting rollers 40. The speed of front rollers 40 will understandably vary since the system is autoleveling and the speed of front rollers 40 must by necessity be determined by the speed of back rollers 30 as well as the draft which is going to be imparted to the sliver to promote uniformity. The speed of front rollers 40 and information from sliver level sensor 60 can be used to determine the speed at which coiler can 70 collects sliver 20.

The automated drafting system for textile strands provided by the present invention therefore comprises: (1) a synchronous drive sliver drafting roller system; (2) a system for securing and pressuring together the upper and lower sliver drafting rollers; (3) a sliver autoleveling system using tongue and groove drafting rollers as sliver uniformity sensing means; (4) a feed-forward and feed-back autoleveling system for control of sliver drafting rollers; and (5) a draftless sliver coiler packaging system. For purposes of explanation and illustration, each of these novel component systems of the integrated automated drafting system according to this invention will be separately described hereinbelow. It is envisioned, however, that each system described below could be incorporated into a sliver drafting system without the other systems or incorporated into a sliver drafting system with any suitable combination of the other novel systems described herein.

INDIVIDUAL NOVEL SYSTEMS OF AUTOMATED DRAFTING SYSTEM

(1) Synchronous Drive Sliver Drafting Roller System

In accordance with the present invention, the automated drafting system for textile strands provided herein preferably comprises a novel synchronous drive sliver drafting roller system. As shown in FIG. 1, separate motors M1 and M2 preferably drive each lower roller 34 and 44, respectively, of a given pair of upper and lower rollers 30 and 40, respectively. Each motor electrically communicates with and is controlled by suitably programmed computer C.

Figure 2:
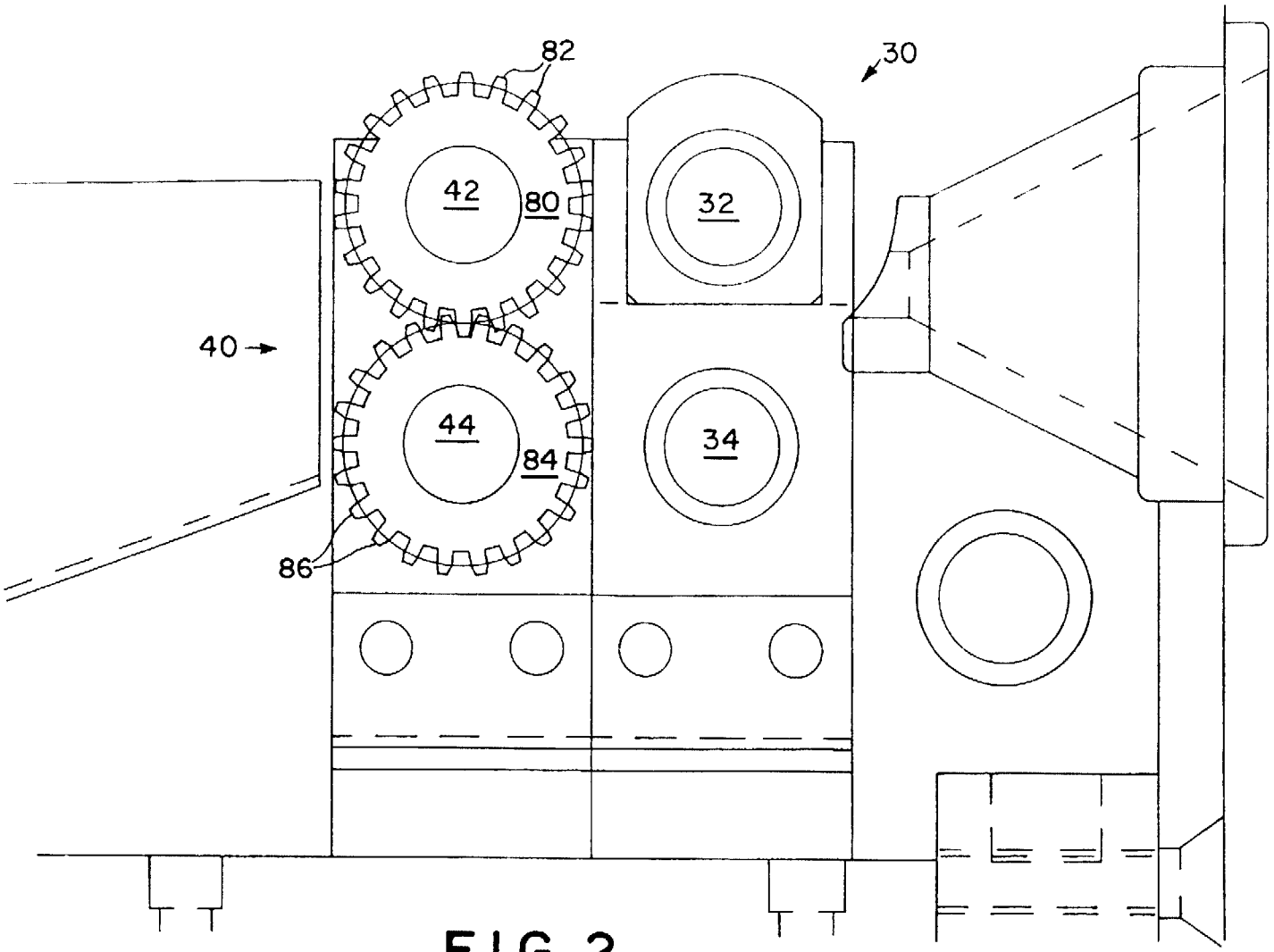
FIG. 2 is a side elevation view of a preferred embodiment of a drafting apparatus according to the present invention illustrating the use of gears to directly drive the upper drafting roller.
Figure 3B:
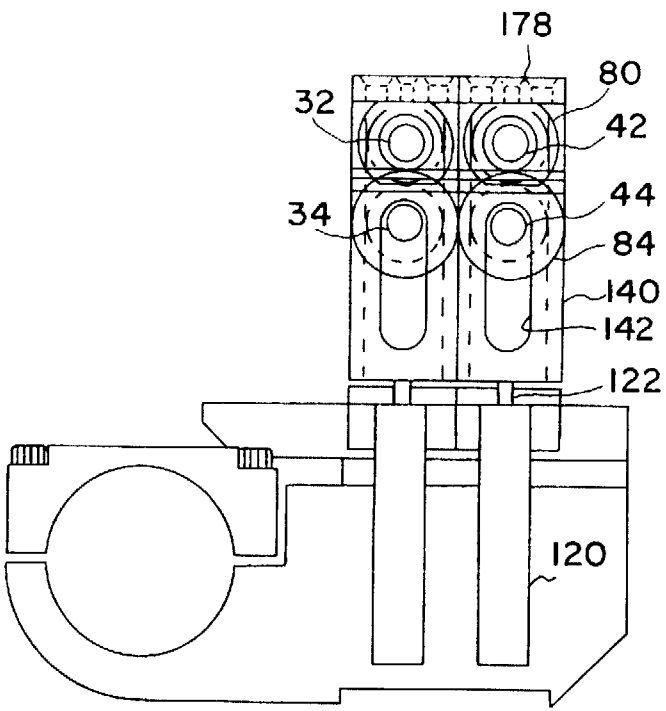
FIG. 3B is a side view of the drafting apparatus shown in FIG. 3A.
Figure 3A:
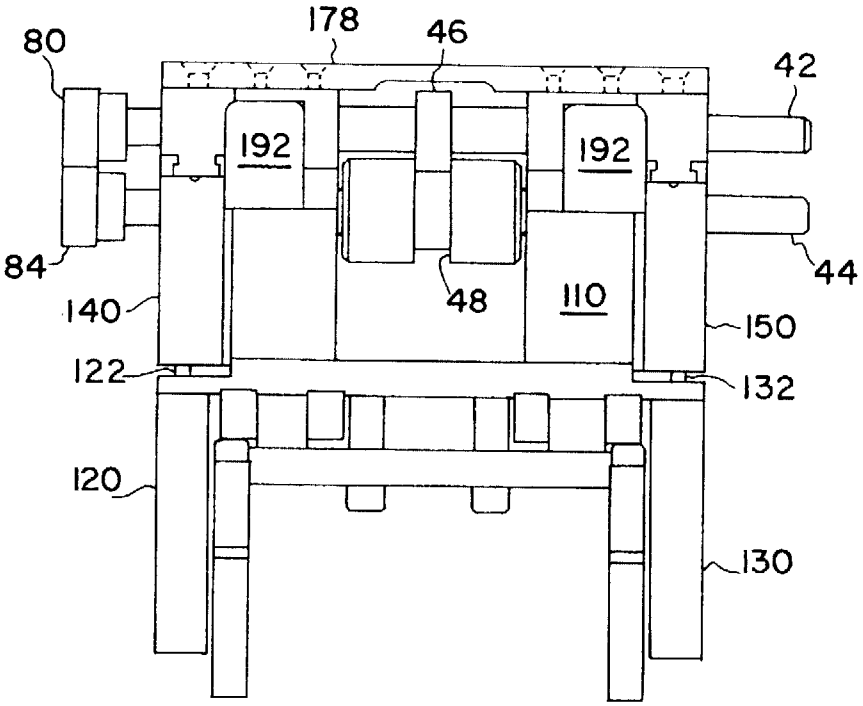
FIG. 3A is a front end view of a preferred embodiment of a drafting apparatus according to the present invention illustrating the front pair of rollers thereof.
Figure 4:
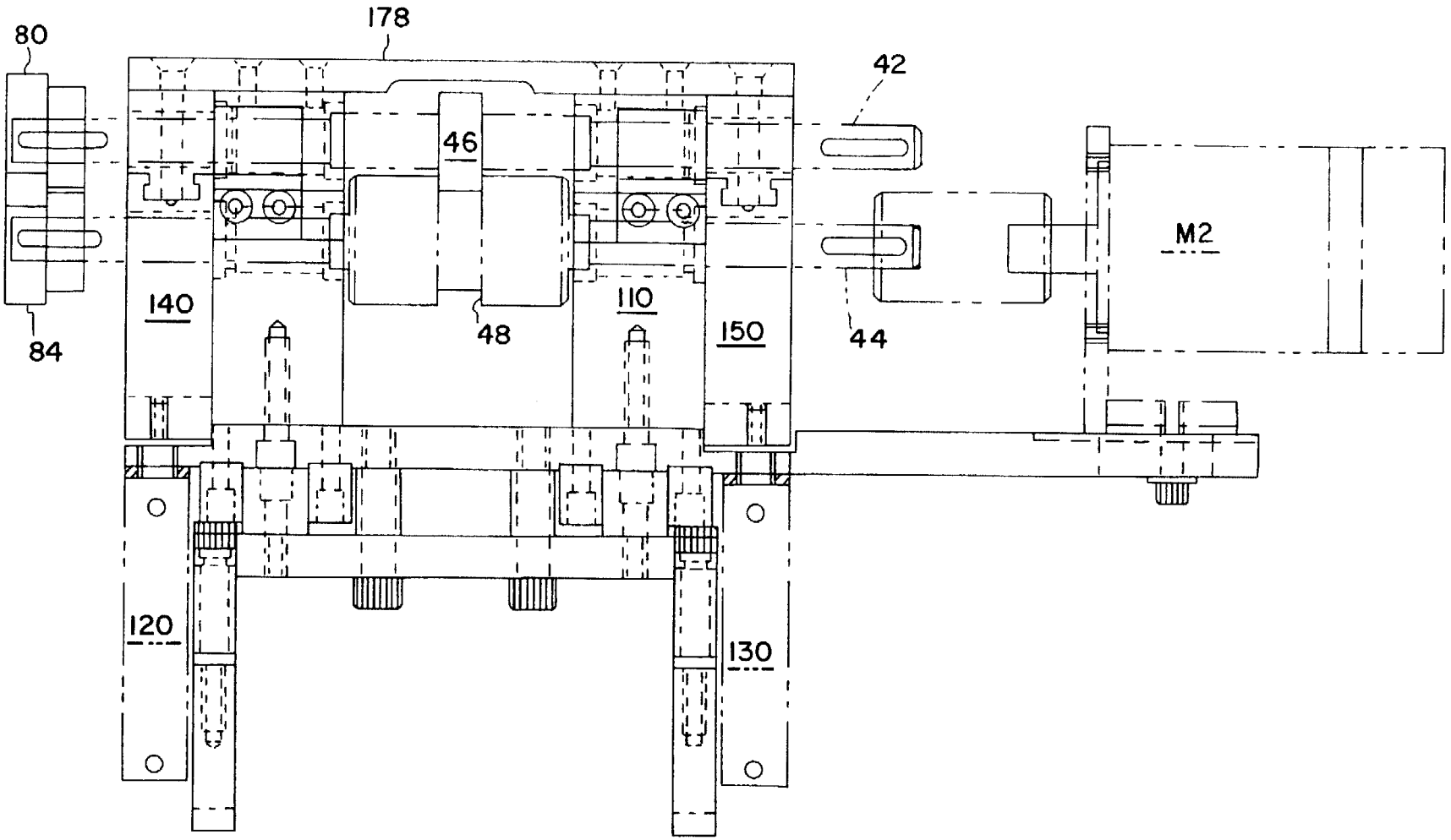
FIG. 4 is a front end view of a preferred embodiment of a drafting apparatus according to the present invention with a motor operatively connected thereto for directly driving the bottom roller.

Referring particularly to FIGS. 2–4, the synchronous drive sliver drafting roller system comprises two pairs of rollers, back rollers generally designated 30 and front rollers generally designated 40. Back rollers 30 include upper roller 32 and lower roller 34, and front rollers 40 include upper roller 42 and lower roller 44. The upper and lower rollers of each pair of rollers preferably comprises a cylindrical shaft wherein the shafts of the upper and lower rollers are spaced apart and parallel to one another.

While the upper and lower rollers of a given pair of rollers in prior art drafting systems for drafting sliver have traditionally been pressed against one another and surface friction driven, the upper and lower rollers within a pair of rollers according to this invention utilize a direct drive system not heretofore utilized in sliver drafting systems. Still referring to FIGS. 2, 3A, 3B and 4, and using front rollers 40 as an example to illustrate the synchronous drive system according to this invention, upper roller 42 and lower roller 44 each have a toothed gear 80 and 84, respectively, attached to one end of the shaft of each roller. The shaft of each roller is preferably of identical diameter, and gears 80 and 84 are also preferably of identical diameter and identical pitch and preferably define the same number of teeth, such as teeth 82 and 86, respectively, thereon. In the drafting position, a portion of the teeth of each upper and lower gear are operatively intermeshed such that rotation of either gear 80 or 84 to rotate the corresponding shaft and roller, causes identical rotational movement of the other gear, shaft and roller, as best illustrated in FIG. 2 of the drawings with reference to the gears of the front rollers. The gears of front and back rollers 40 and 30, respectively, can be positioned on opposite sides of the rollers as shown in FIG. 4, or they can be positioned on the same side of front and back rollers 40 and 30, respectively, as shown in FIG. 3B.

While gears 80 and 84 can be of any suitable construction material, it is preferred that the lower gear, such as gear 84, be metal and that the upper gear, such as gear 80, be constructed of a polymeric material such as nylon. Gears 80 and 84 each preferably comprise eighteen (18) teeth in a preferred embodiment. The inside diameter of each gear is preferably approximately one-half (½) inch with a key way of approximately three-sixteenths (3/16) inch.

In accordance with this invention, the lower roller, such as, for example, lower roller 44, of each pair of upper and lower rollers is directly driven and in turn directly drives the upper roller, such as, for example, upper roller 42, because of the intermeshed, operative connection of gears 80 and 84 of each pair of rollers. While it is envisioned that any conventional means can be used to drive the lower roller of each pair, a motor, such as motor M2, is preferably operatively connected to the shaft of the lower roller, such as lower roller 44, on an opposite end from gear 84 in order to rotate the shaft and corresponding roller, as illustrated in FIG. 4 of the drawings. Motor M2 can be any suitable AC servomotor for driving lower roller 44.

Computer C controls motors M1 and M2 for driving each lower roller through corresponding servopacks, such as servopacks 100 and 102 shown in FIG. 1. Motors M1 and M2 are YASKAWA brand servomotors Model Number SGM-04A314, and the servopacks are YASKAWA brand Model Number SGD-04AS, both commercially available from Regan Controls of Charlotte, N.C. Computer C preferably comprises a motor control board, such as the UMI4-A-Universal Motion Interface, commercially available from Nulogic Inc. of Needham, Mass. and a 3004 pc Control 4-Axis Servomotor Controller, commercially available from Nulogic Inc.

Motor M2 transmits rotational power to lower roller 44, and lower roller 44 transmits rotational power to upper roller 42 through the interaction of intermeshed gears 80 and 84. This direct drive connection of the lower and upper rollers of a given pair of rollers causes the rotational surface speeds of the lower and upper rollers to be identical and to thereby impart highly uniform drafting forces to the sliver strand passing therebetween.

Use of the synchronous drive system as taught herein in a sliver drafting roller system is advantageous for a number of reasons which will be apparent to those of skill in the textile art. A primary advantage of using the synchronous drive system as taught herein is that the lower and upper rollers of a given pair no longer need to be cylindrical along the entire lengths thereof in order for one to frictionally drive the other by surface contact. Since the lower and upper rollers of a pair do not have to be friction driven, the traditional materials of construction designed for fictionally driving the rollers no longer have to be utilized, and it can be appreciated that the rollers can now be made of a variety of suitable materials with no restriction that the materials be adapted for frictionally engaging one another to drive the rollers.

The identical speed of the rollers is distinctly advantageous since it eliminates the chance of slippage and potential damage to drafted textile fibers resulting therefrom which is a problem with friction-driven rollers. Quite importantly, the synchronous drive system as taught herein also enables the pairs of drafting rollers utilized to be tongue and groove rollers which, as discussed in detail hereinbelow, provide distinct advantages over cylindrical rollers for drafting sliver as will be apparent to those of skill in the textile drafting art.

It is therefore seen that the present invention provides a novel synchronous drive sliver drafting roller system providing many advantages over conventional drafting systems and whereby each pair of the drafting rollers can be driven at identical surface speeds without the surfaces frictionally engaging one another.

(2) System For Securing Together and Pressuring Into Operative Engagement the Upper and Lower Sliver Drafting Rollers In accordance with the present invention, a novel system for securing and pressuring sliver drafting rollers in a sliver drafting system is provided and illustrated in FIGS. 5A–B, 6A–C and 7. Lower rollers 34 and 44 of back rollers 30 and front rollers 40, respectively, are each fixedly attached to a frame such that each is only rotationally movable. For example, FIGS. 5A, 6A, and 6C each show front rollers 40, and lower roller 44 thereof is attached to frame 110 such that lower roller 44 is still rotationally movable. Lower roller 44 as a whole, however, cannot be moved horizontally, vertically or diagonally because of its fixed, but rotationally movable attachment to frame 110. It is envisioned according to this invention that the lower rollers 44 and 34 of the front and back pair of rollers 40 and 30, respectively, can both be positioned within the same or separate frames.

The upper roller of each roller pair is held within a frame and pressured or urged against the fixedly-held lower roller of the pair according to this invention. This pressuring is important to ensure that the gears of each pair of rollers, such as gears 80 and 84 (shown in FIGS. 2, 3A–B and 4 of front rollers 40), are intermeshed with one another by their teeth while the rollers are in a drafting position. Additionally, such pressuring is critical to proper functioning of the tongue and groove roller system as further discussed hereinbelow.

Figure 5B:
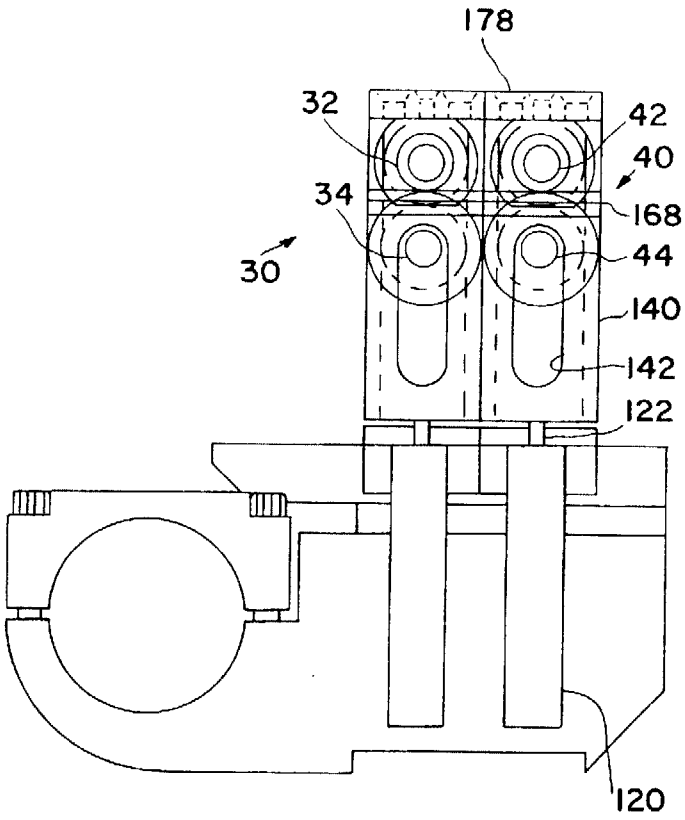
FIG. 5B is a side view of the drafting apparatus shown in FIG. 5A.
Figure 5A:
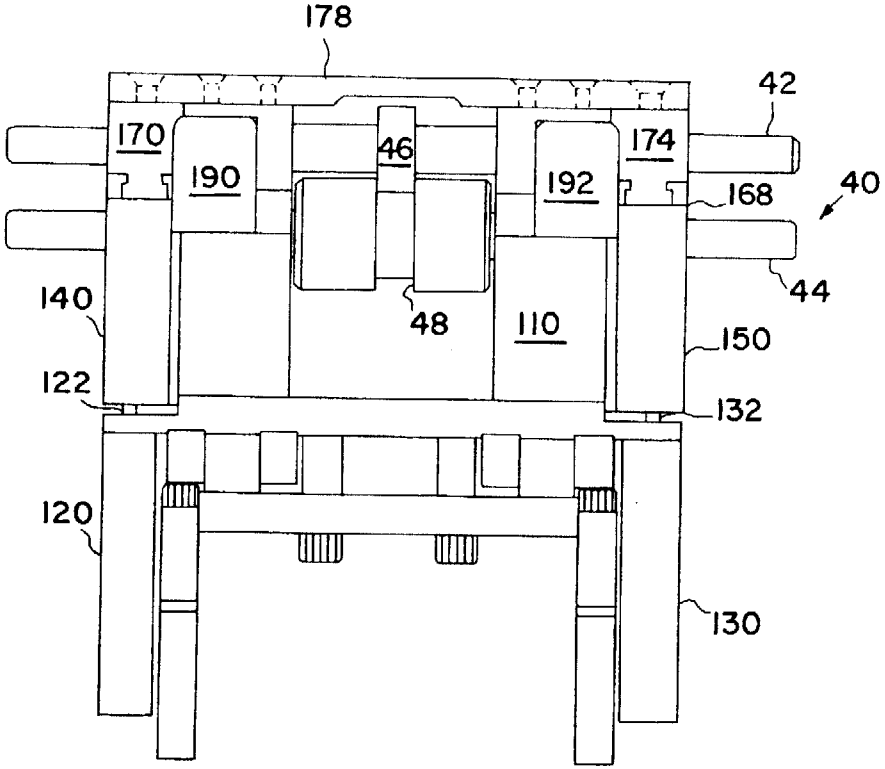
FIG. 5A is a front end view of a drafting apparatus according to the present invention illustrating the rollers thereof in normal operating position with the pneumatic cylinders retracted.

Pressuring of each upper roller 42 and 32 against each lower roller 44 and 34, respectively, according to this invention is accomplished by the use of pneumatic cylinders which are fixedly attached to the frame supporting lower rollers 44 and 34. For example, pneumatic cylinders 120 and 130 are fixedly attached to frame 110 as shown in FIGS. 5A, 6A, and 6C. Extending from each cylinder 120 and 130 is a rod 122 and 132, respectively. Rods 122 and 132 extend from cylinders 120 and 130, respectively, at one end thereof and are connected to side support members 140 and 150, respectively, at the opposite end thereof. Side support members 140 and 150 each define a slot, such as slot 142 of side member 140, with each slot being adapted to receive the shaft of a corresponding lower roller therethrough. With the lower rollers fixedly held in position, cylinders 120 and 130 can be activated to raise or lower side members 140 and 150, respectively, as desired whereby each pair of side members moves vertically upwardly with the shaft of the corresponding lower roller received through the slots of the side members remaining stationary.

Figure 7:
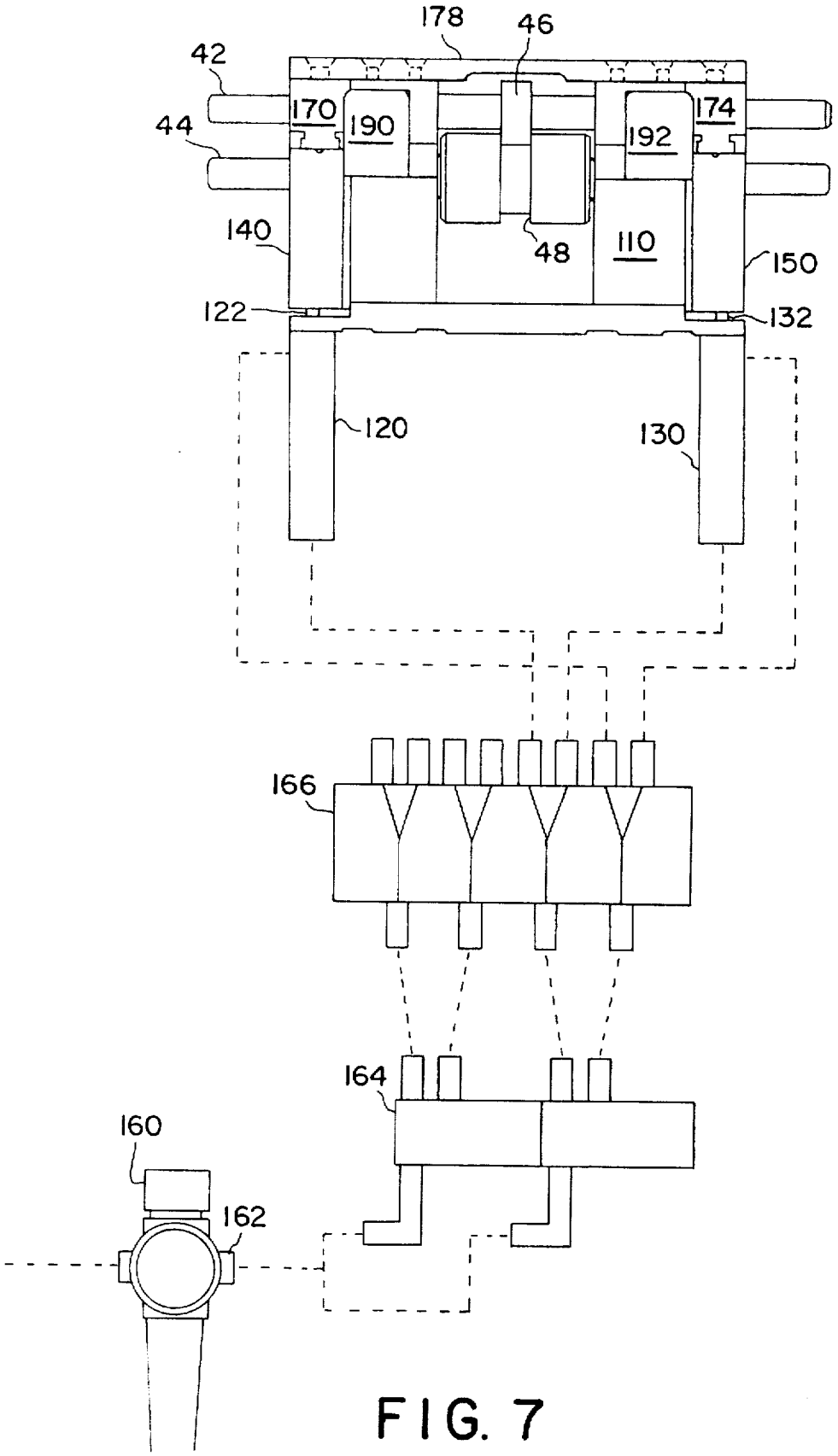
FIG. 7 is a schematic illustration showing how air is provided to the pneumatic cylinders used to elevate the upper drafting rollers according to the present invention.

FIG. 7 of the drawings illustrates how pneumatic cylinders 120 and 130 according to this invention are controlled. An adjustable regulator 160 controls the amount of air allowed to pass through an air inlet 162. The air passes to a valve, preferably a solenoid valve 164, the purpose of which is to control the position of cylinders 120 and 130 as they can be in a fully extended position, a fully retracted position, or anywhere in between. The fully retracted position is the normal operating position for the pneumatic cylinders. Opening of solenoid valve 164 causes cylinders 120 and 130 to extend as air pressure passes from solenoid valve 164 to manifold 166. There, the air passing therethrough is split, allowing an equal amount of air to pass simultaneously to both cylinders 120 and 130 in order to ensure that constant pressure and force is exerted to both cylinders 120 and 130. The functioning of the solenoid valve is important during normal operation since if a sliver lap-up has occurred to one of the upper or lower rollers or if some fiber has begun to build-up on a roller, a safety mechanism exists to avoid potential damage to the roller since the solenoid valve will be triggered and cause cylinders 120 and 130 to move from the retracted or normal operating position to the extended position which separates the upper and lower drafting rollers as described further hereinbelow.

While the lower roller of each drafting roller pair is fixedly maintained so as to only allow rotational movement thereof, the upper roller of each pair is vertically movable toward and away from the corresponding lower roller. Such vertical movement of the upper roller of each pair is preferably accomplished by slidable movement of the frame holding each upper roller. The frame holding each upper roller preferably comprises a laterally extending upper portion, which includes the upper roller, and opposing side members 140 and 150, depending downwardly from opposite ends of the upper portion. The slidable movement of each upper roller 42 and 32 is therefore provided for by the slots, such as slot 142 of side member 140, of each pair of side members and each pair of pneumatic cylinders attached thereto, as described above. According to this invention, the upper portion of the frame of each upper roller is slidably attachable to and removable from the side members to which each upper portion is attached. It is envisioned according to this invention that any suitable means for slidable attachment and removal of each upper portion could be utilized.

Figure 6B:
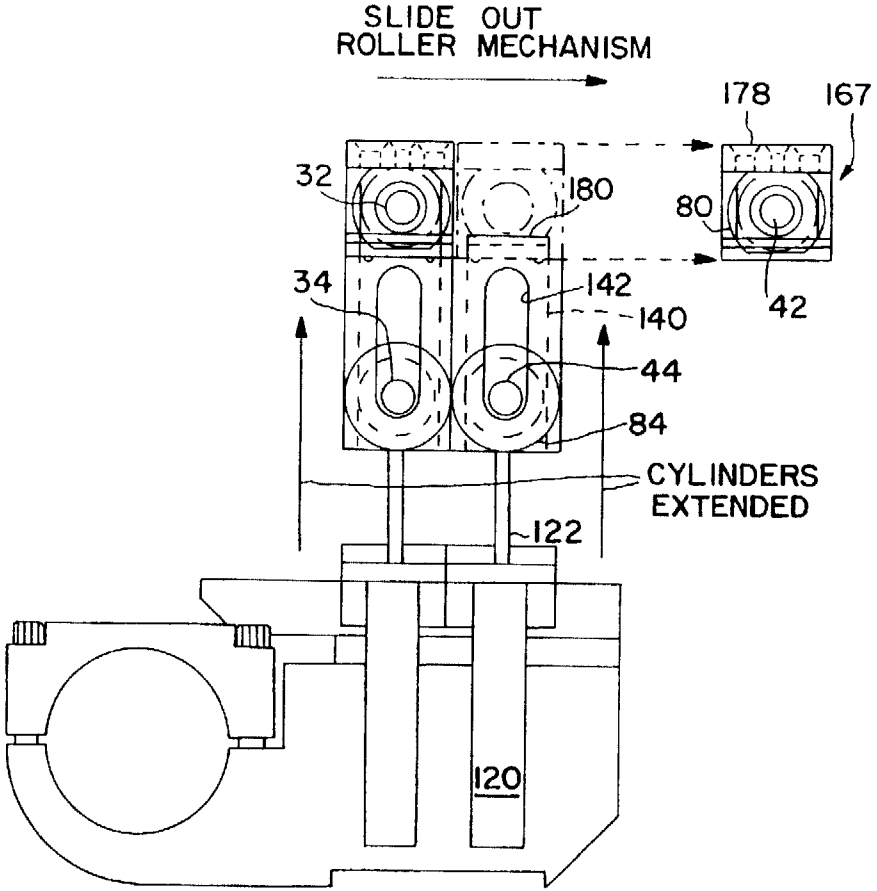
FIG. 6B is a side view of the drafting apparatus shown in FIG. 6A and with the front upper roller slidably removed therefrom.
Figure 6A:
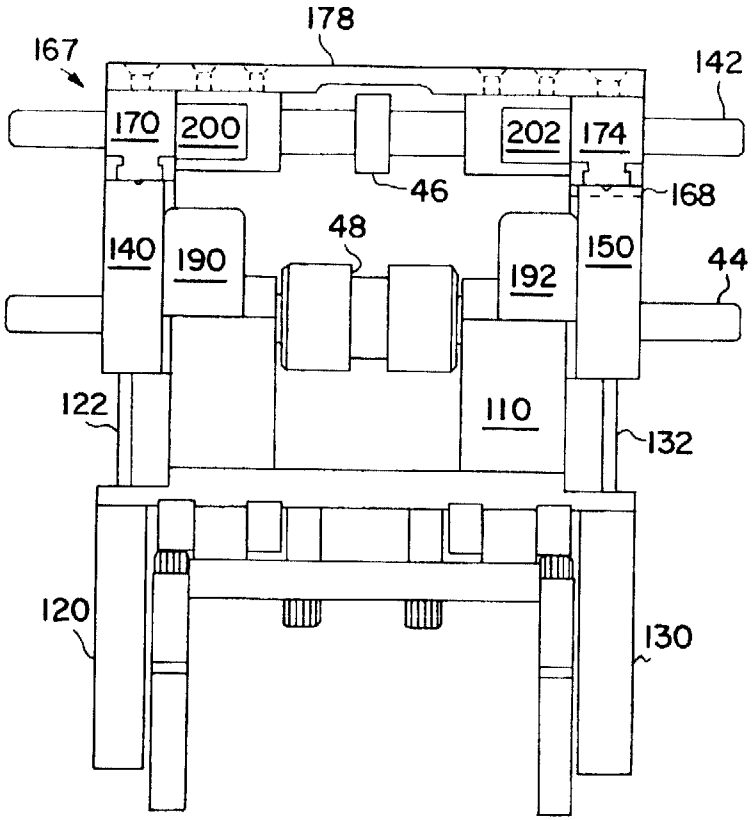
FIG. 6A is a front end view of the drafting apparatus shown in FIGS. 5A and 5B but with the pneumatic cylinders extended and the rollers thereof spaced-apart for removal of the upper rollers.
Figure 6C:
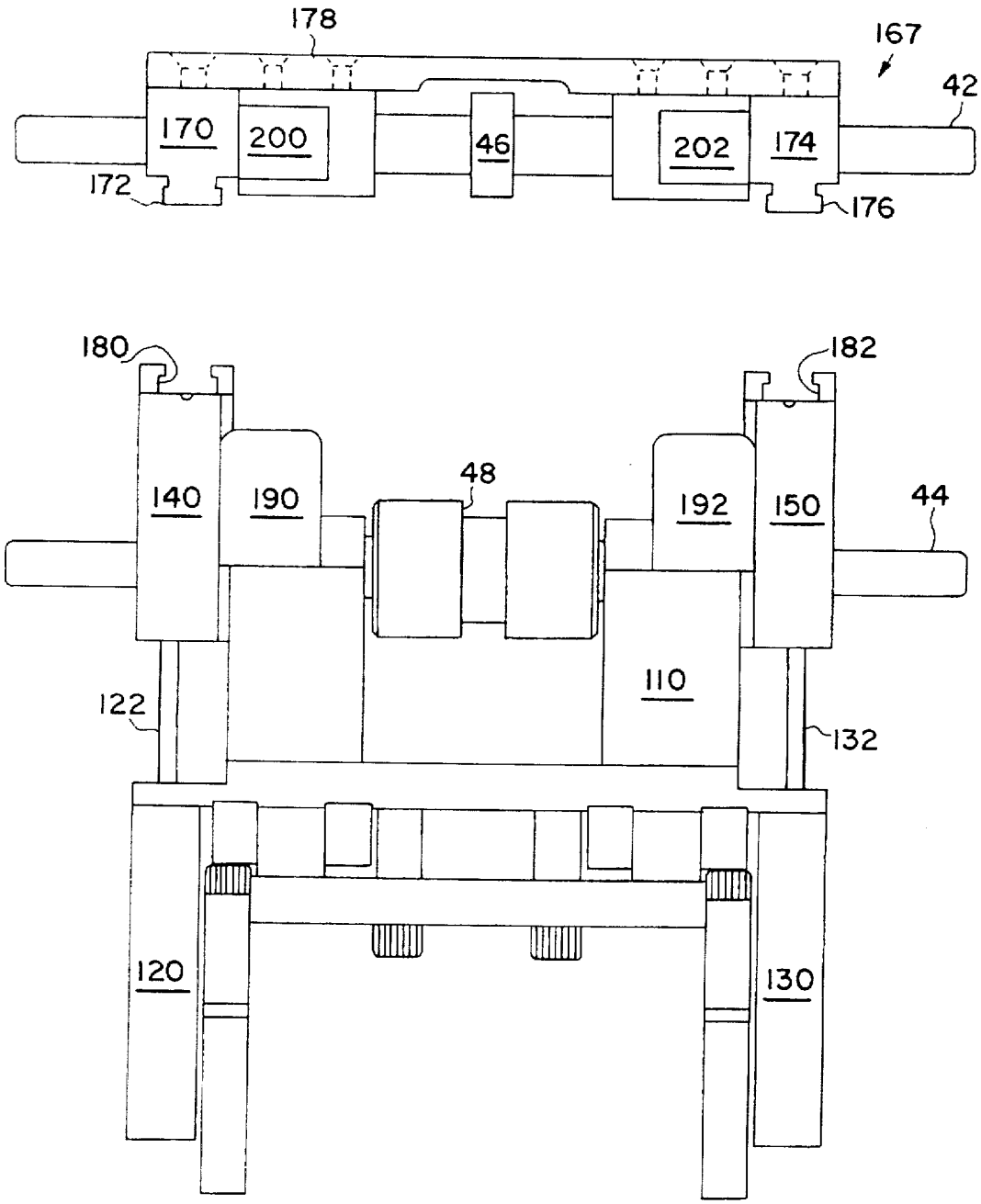
FIG. 6C is a front end view of the drafting apparatus shown in FIG. 6A with the front upper roller slidably removed and the pneumatic cylinders extended.

As an example of the preferred attachment of the upper portion of each upper roller frame, and with particular reference to FIGS. 6A, 6B and 6C, the upper portion, generally referred to as 167, includes upper roller 42 which is rotatably positioned with frame 168. Opposing bearing housings 170 and 174 are part of frame 168 and have upper roller 42 rotatably mounted therethrough. Bearing housings 170 and 174 are both connected to opposing ends of a top plate 178. Top plate 178 can optionally be removed so that each bearing housing can function independently. Each bearing housing 170 and 174 defines a T-shaped key or appendage 172 and 176, respectively, on the bottom side thereof which is adapted to be slidably received within an inverted T-shaped slot 180 and 182, respectively, on the upper side of each side member 140 and 150, respectively. In this manner, upper portion 167 and upper roller 42 can be vertically fixedly attached to side members 140 and 150 whereby upper portion 167 and upper roller 42 can only be removed therefrom by horizontally sliding the T-shaped appendages of each bearing housing out of the corresponding T-shaped slots of the side members. Such removal can only be accomplished by horizontal movement of upper portion 167 and upper roller 42 when upper roller 44 and lower roller 44 are in vertical alignment for normal drafting operation.

When cylinders 120 and 130 are retracted for normal operation of the upper and lower rollers of a roller pair, a portion of each upper roller frame is positioned within a groove or slot defined within finger plate 190 and 192 illustrated in FIGS. 5A, 6A and 6C. Preferably, a pair of opposing front and back finger plates are utilized as each is fixedly attached to frame 110. Bearing housings 170 and 174 of upper roller 42 each define a pair of opposing flat portions, such as front flat portions 200 and 202, respectively, and the flat portions of each bearing housing preferably slide down and contact a corresponding finger plate when upper roller 42 is in its normal operating position with cylinders 120 and 130 retracted. The bearing housings of each upper roller therefore are positioned substantially between a pair of front and back finger plates in the normal operating position, and the alignment of the bearing housings within the finger plates thereby restricts horizontal movement of each upper roller by restricting such movement of the bearing housings. It can therefore be understood that each upper roller, such as upper roller 42, can be attachably connected to the side members, such as side members 140 and 150, whereby both horizontal and vertical movement of each upper roller are advantageously restricted when the upper roller is in its normal operating position with the corresponding cylinders retracted. FIGS. 5A and 5B of the drawings illustrate the retracted position of the pneumatic cylinders with the upper rollers of each roller pair in a position for normal operation.

It is extremely important that the upper roller, such as upper roller 42, of each roller pair be quickly removable when desired, and the securement of each upper roller, such as upper roller 42, as described herein enables the upper roller to be so removed. As can be appreciated, removal of upper roller 42 can only occur when corresponding cylinders 120 and 130 are in an extended position, as illustrated, for example, in FIGS. 6A and 6B, since both horizontal and vertical movement of upper roller 42 are restricted when cylinders 120 and 130 are retracted. Once cylinders 120 and 130 are extended as illustrated in FIG. 6A, upper roller 42 has been raised above finger plates 190 and 192 such that the horizontal movement necessary for removal of upper roller 42 can occur. FIG. 6B illustrates upper roller 42 removed from side members 140 and 150.

When the upper and lower roller of a roller pair are in vertical alignment such as for normal drafting operation, the only movement of the upper roller which is allowed according to this invention is vertical movement as caused by its corresponding pneumatic cylinders to pressure and force the upper roller against the lower roller as desired. The pneumatic cylinders and corresponding control as described herein can be used such that the pressure with which the upper roller presses or is forced against the lower roller is constantly regulated.

It is therefore seen that the present invention provides a novel system for securing and pressuring together the upper and lower rollers of each roller pair in a sliver drafting system. This system advantageously can maintain the upper roller and lower roller of each pair of rollers in a stable alignment with the upper roller pressured against the lower roller. Also, the upper roller of each pair can be quickly and easily raised and removed from such alignment as desired.

(3) Sliver Autoleveling System Using Tongue and Groove Drafting Rollers As Sliver Uniformity Sensing Means In accordance with the present invention, a novel sliver autoleveling system using cooperating tongue and groove drafting rollers as sliver uniformity sensing means is provided. Each pair of rollers according to this invention comprises a tongue and groove-type pair of rollers. The tongue and groove rollers themselves are utilized for drafting as well as in association with linear variable differential transformers (LVDTs) in order to continuously sense sliver uniformity during the drafting process.

As illustrated in FIGS. 3A, 4, 5A, 6A, 6C, 7 and 8, both the back and front pairs of drafting rollers, 30 and 40, respectively, according to this invention are tongue and groove-type drafting rollers. Each upper roller of a given pair includes an area of increased diameter referred to as a "tongue", and each lower roller of a pair of rollers includes or defines an area of decreased diameter referred to as a "groove" wherein the groove of each lower roller is adapted to snugly receive the tongue of the corresponding upper roller. In the preferred embodiment according to this invention, the width of the tongue and groove is approximately one-half (½) inch. During drafting, sliver passes between the tongue and groove of each pair of rollers where the sliver is nipped between the tongue and groove. The tongue and groove rollers preferably do not contact one another anywhere except sometimes in the area where the tongue meets the groove. The maximum separation distance preferred during drafting between the tongue and groove of each pair of rollers is approximately 0.06 inch.

As stated hereinbefore, it is a primary advantage of tongue and groove rollers that they enable the precise volume of textile fiber passing therethrough to be known. The use of tongue and groove rollers as taught herein therefore enables the precise volume of textile fiber passing between the tongue and groove to be known since the width of the fiber strand is dictated by the width of the tongue and groove, and the depth or thickness of the fiber strand can be measured by how far the tongue and groove rollers separate. Knowing the mass density of the fiber strand or simply through calibration as described hereinbelow, the total mass of textile fiber passing through the drafting system can be determined.

Figure 8:
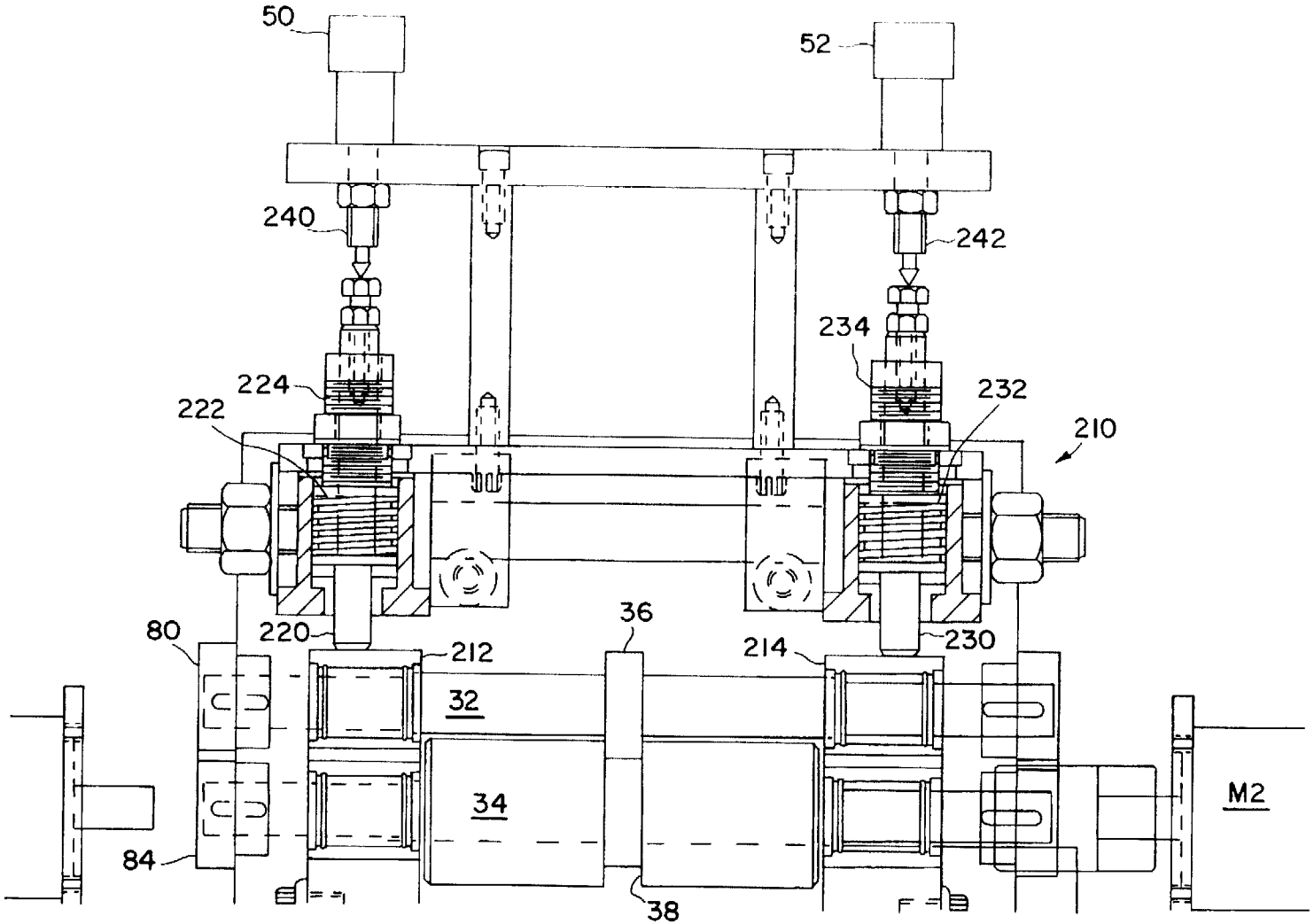
FIG. 8 is a front view of a drafting apparatus according to the present invention with tongue and groove rollers and linear variable differential transformers (LVDTs) operatively associated therewith for detecting sliver strand uniformity.

Referring to FIG. 8 of the drawings, an example of the tongue and groove roller drafting system according to this invention is illustrated. As shown, upper roller 32 of back rollers 30 includes a tongue 36, and corresponding lower roller 34 includes a groove 38 wherein tongue 36 is partially received within groove 38. The space between tongue 36 and groove 38 is adapted to receive sliver as it is controllably pressured between tongue 36 and groove 38 during drafting of the sliver. As illustrated in FIGS. 3A, 4, 5A, 6A, 6C and 7, upper roller 42 of front rollers 40 also includes a tongue 46 while lower roller 44 of front rollers 40 includes a groove 48 for receiving tongue 46.

Each pair of tongue and groove rollers according to this invention is preferably utilized in association with one or more LVDTs which are used to sense sliver uniformity during the drafting process by monitoring vertical displacement of the upper roll of each pair of rollers. The LVDTs can be DC-DC Gaging Transducers, Model Number 0351-000, commercially available from TransTek of Ellington, Conn.

As discussed hereinabove with reference to FIGS. 5A, 5B, 6A–C, and 7, the top plate attached to the bearing housings of each upper roller is utilized to maintain the bearing housings in a parallel relationship to one another. According to this invention, one or more LVDTs (preferably two (2)) are positioned above the top plate of each upper roller and utilized in association with computer C to measure the total vertical displacement of the upper roller away from the corresponding lower roller. One LVDT can be positioned above the center of a top plate to contact the top plate and measure total vertical displacement of the upper roller away from the lower roller. This information can be used as an indirect measure of the mass of sliver at that instant passing through the nip between the tongue and groove of the upper and lower rollers, respectively, associated with the top plate.

Figure 9:
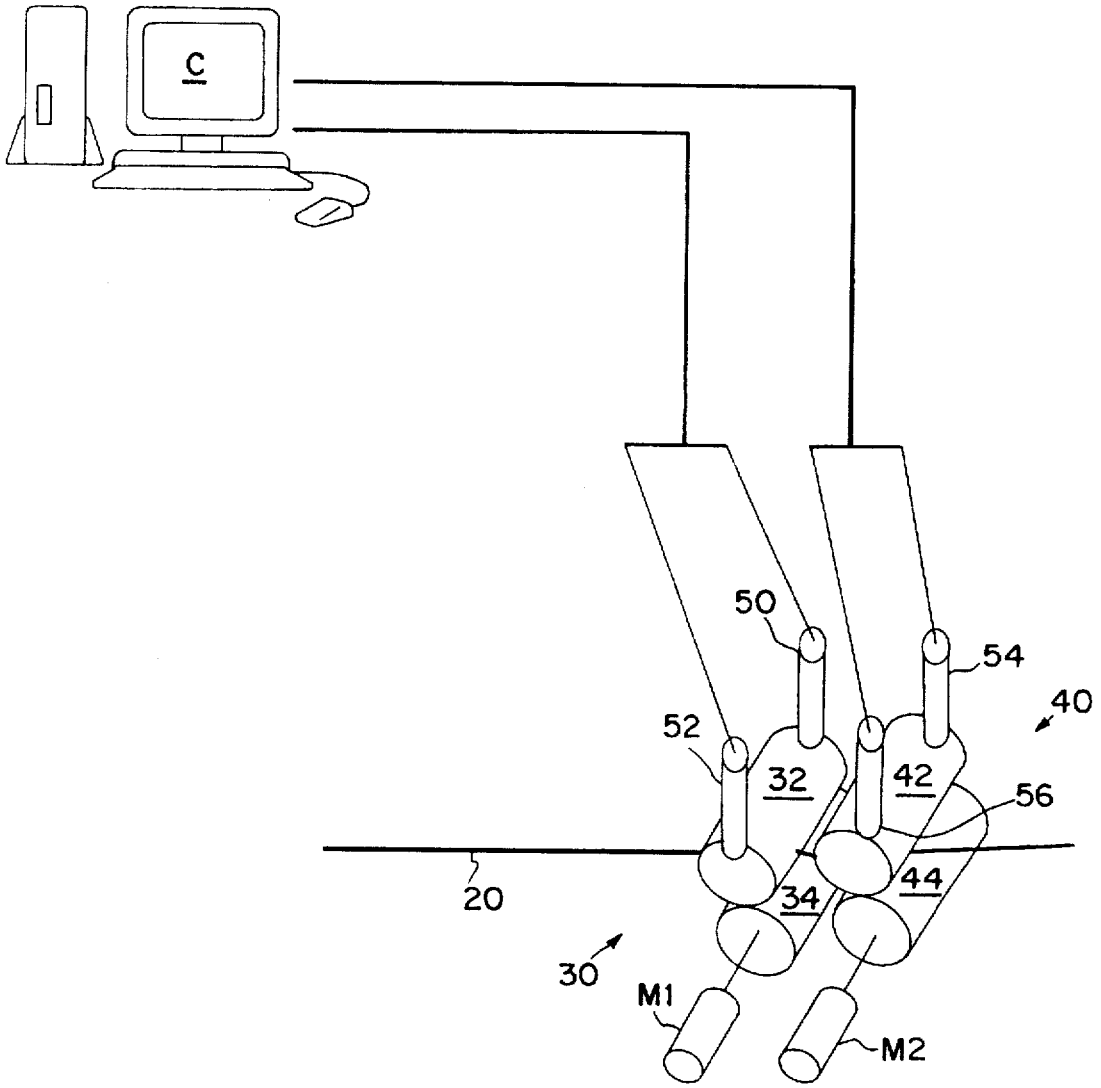
FIG. 9 is a portion of the overall schematic of FIG. 1 schematically illustrating the drafting rollers, linear variable differential transformers (LVDTS) and computer control used in one embodiment of the feedforward and feed-back autoleveling system according to the present invention.

In the preferred embodiment, however, and as illustrated in FIGS. 8 and 9, a pair of LVDTs are utilized with each pair 30 and 40 of back and front rollers. For example, LVDTs 50 and 52 are utilized with back rollers 30, and LVDTs 54 and 56 are utilized with front rollers 40 (see FIG. 1). Each pair of LVDTs is positioned above a corresponding top plate, such as top plate 210 of back rollers 30 in FIG. 8, associated with the pair of rollers so as to be spaced apart from one another and operably secured to opposing ends of the top plate. This embodiment is envisioned as being particularly useful in a situation where the top plate associated with the upper roller of a pair of rollers has been removed and the two bearing housings of the upper roller are allowed to act independently.

With specific reference to FIG. 8 of the drawings, upper roller 32 and lower roller 34 of back rollers 30 are shown, and top plate 210 is attached to bearing housings 212 and 214 of upper roller 32. Load shafts 220 and 230 are utilized to operatively connect bearing housings 212 and 214, respectively, of upper roller 32 to LVDTs 50 and 52, respectively. Load shafts 220 and 230 provide downward pressure on upper roller 32 with such pressure being produced by springs 222 and 232, respectively, whose tension is adjustable by threaded collars 224 and 234, respectively. This downward pressure applied by load shafts 220 and 230 facilitates the elimination of slippage between upper roller 32 and lower roller 34 during drafting of sliver.

Mounted over each load shaft 220 and 230 is LVDT 50 and 52, respectively, and each LVDT 50 and 52 has a plunger 240 and 242, respectively, contacting the top of each load shaft. Sliver traveling between tongue 36 and groove 38 of upper roller 32 and lower roller 34, respectively, will cause upper roller 32 to rise and fall in accordance with variations in sliver diameter since lower roller 34 is maintained in a fixed and stationary position allowing rotational movement only. Vertical movement of upper roller 32 will therefore be sensed by each associated LVDT 50 and 52.

Information from the LVDTs is passed to computer C illustrated in FIGS. 1 and 9. The computer receives information from the pair of LVDTs associated with the back rollers as well as the pair of LVDTs associated with the front rollers simultaneously, and such information received by computer C is indicative of the linear density of sliver passing between the pairs of drafting rollers. This information can be processed by computer C to control and make corrections as needed in the vertical movement of the upper rollers of each roller pair 30 and 40 in order to achieve sliver with a desired linear density.

Where a pair of LVDTs are utilized with each pair of drafting rollers 30 and 40, the information coming from the LVDTs will be averaged by computer C in order to obtain an average vertical displacement of the upper roller of each roller pair. Receipt of the information from the LVDTs associated with back rollers 30 enables a determination to be made of the measurement of the thickness of sliver or the mass of the sliver at the location of back rollers 30, which is prior to entering the drafting zone between roller pairs 30 and 40. A determination can automatically be made by computer C as to whether the sliver needs more or less draft, and the speed of the second pair of rollers, front rollers 40, can be adjusted accordingly in order to provide the desired draft. This type of adjusting is feed-forward correction or autoleveling.

Information from the LVDTs associated with front rollers 40 enables the output linear density or the mass per unit length along the sliver to be known and monitored, and such information can be used as a feed-back controller to ensure that the weight of the sliver is correct over a long term.

Figure 10A:
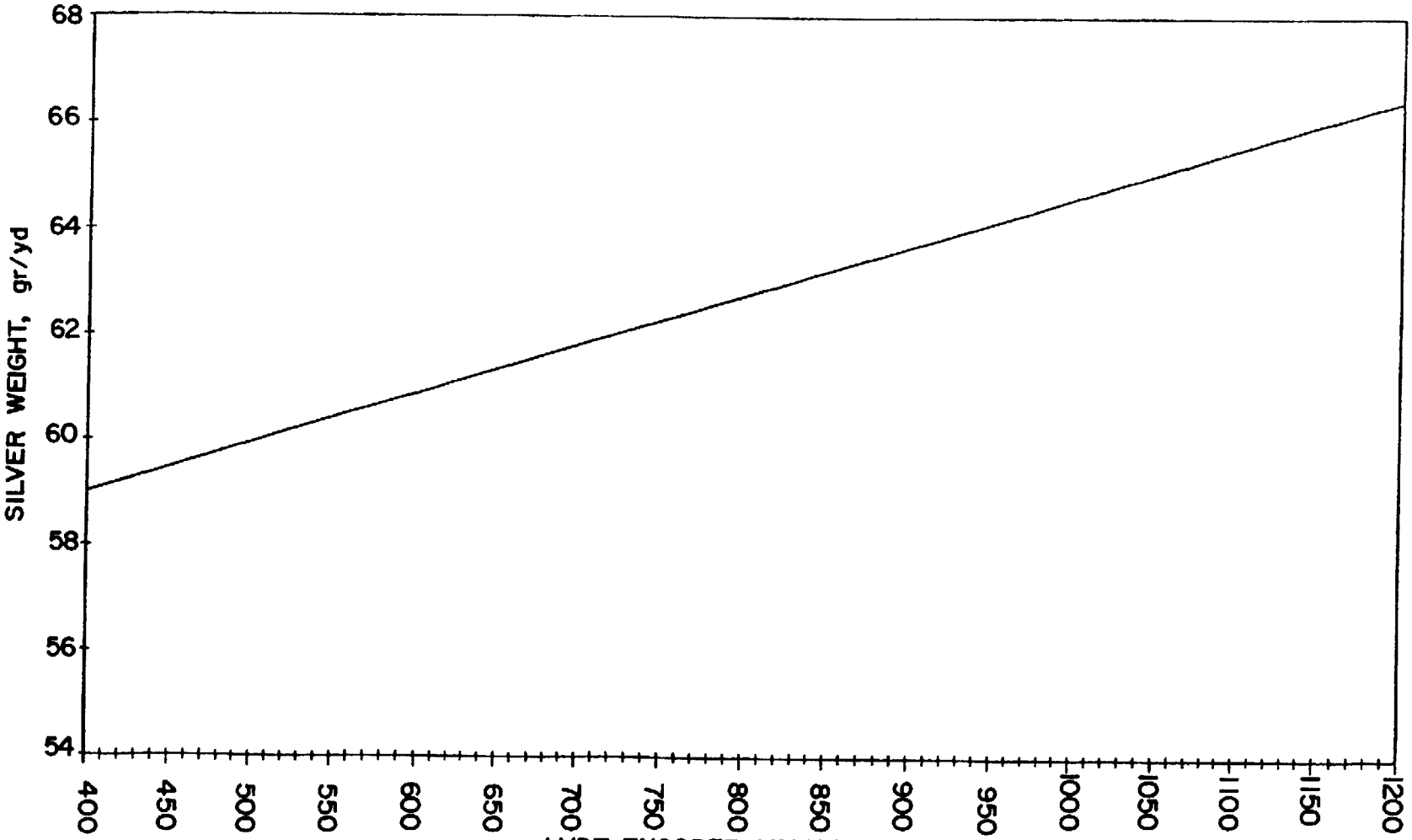
FIG. 10A is a graph illustrating calibration of LVDTs associated with the front rollers of a drafting apparatus according to the present invention.
Figure 10B:
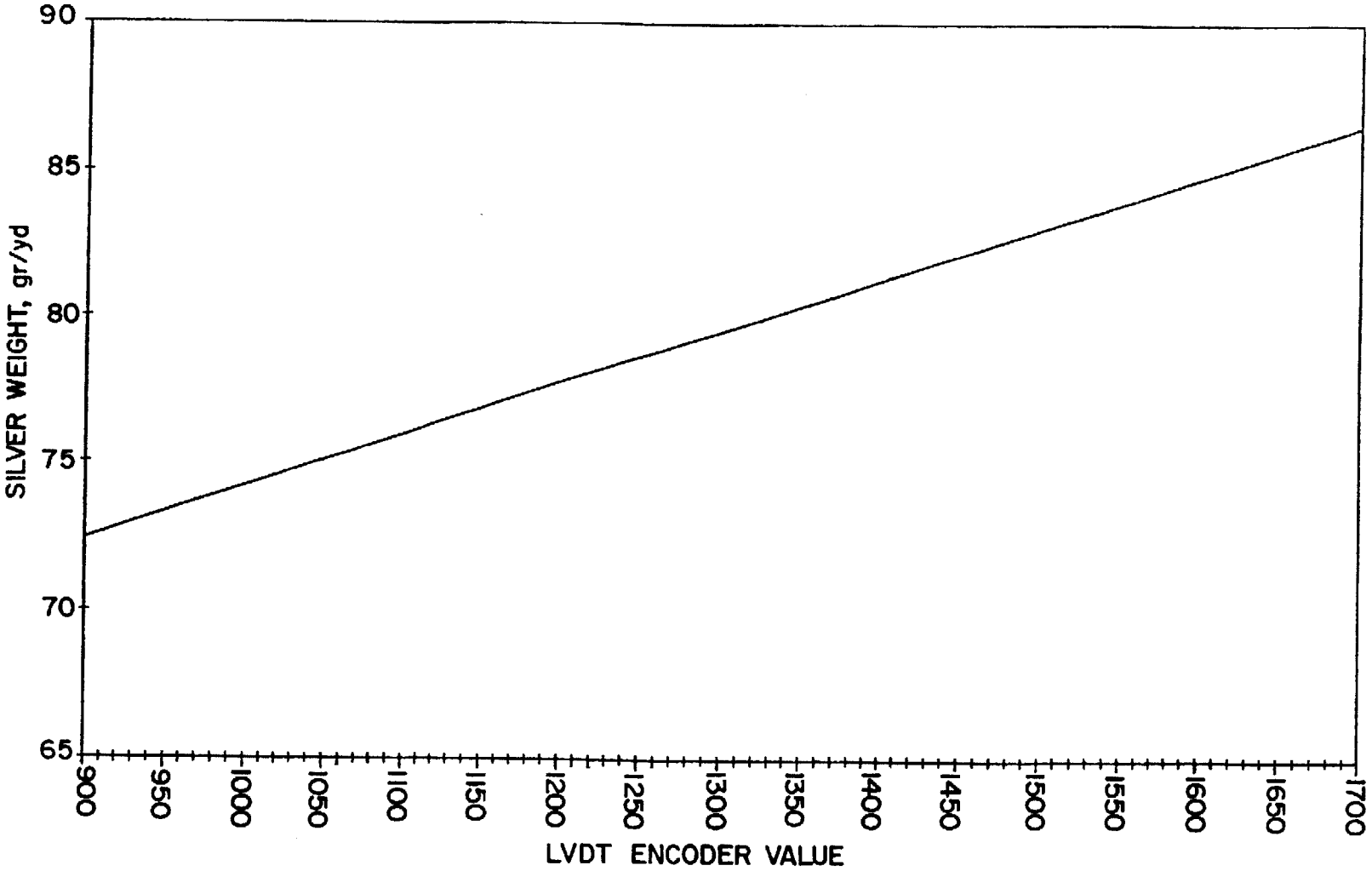
FIG. 10B is a graph illustrating calibration of LVDTs associated with the back rollers of a drafting apparatus according to the present invention.

In order to utilize the LVDTs associated with front drafting rollers 40 as the source of the input signal for an autoleveling system, the signal or information coming from LVDTs 50 and 52 has to be calibrated as to the rollers utilized, the width of the tongue and groove, the pressure on the rollers, and the type of textile fiber passing through the drafting system. This calibration of the LVDTs preferably occurs so that a certain lift or vertical displacement of the upper roller of each pair of rollers will be known to correspond to a particular weight or mass of sliver passing therethrough. Referring to FIGS. 10A and 10B, a graph of the calibration curves for the front rollers and back rollers 40 and 30, respectively, can be seen. In each graph, the dependent variable is the encoder value from the LVDTs which constitutes the signal coming from the LVDTs, and the independent variable is the weight of the sliver in grams per unit yard. Calibration of the LVDTs understandably enables computer C to determine whether a correction in the amount of drafting needs to occur as well as the magnitude of any necessary correction.

Figure 11A:
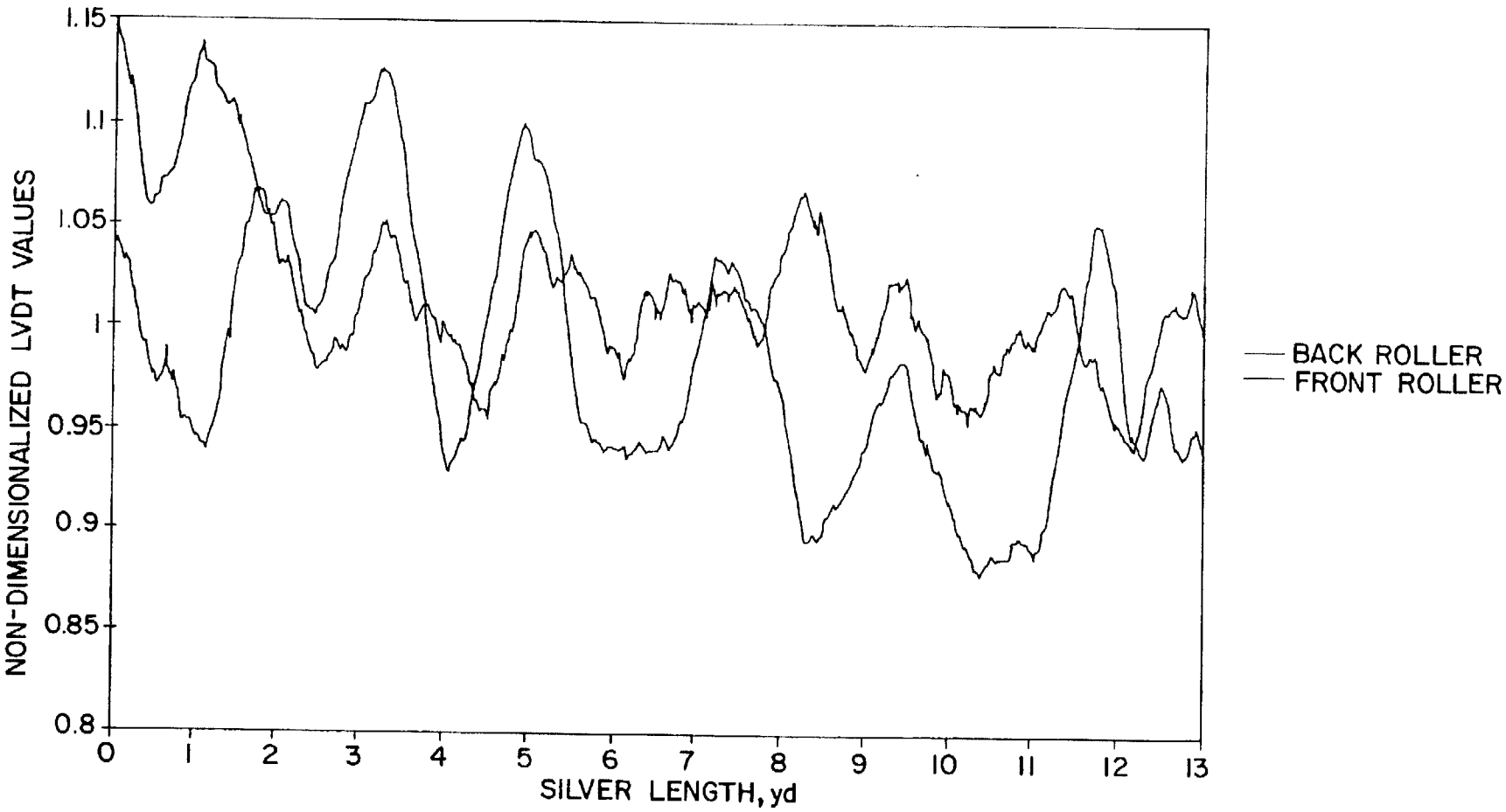
FIGS. 11A and 11B are graphs illustrating improvement of sliver from utilization of the autoleveling system with LVDTs according to the present invention.
Figure 11B:
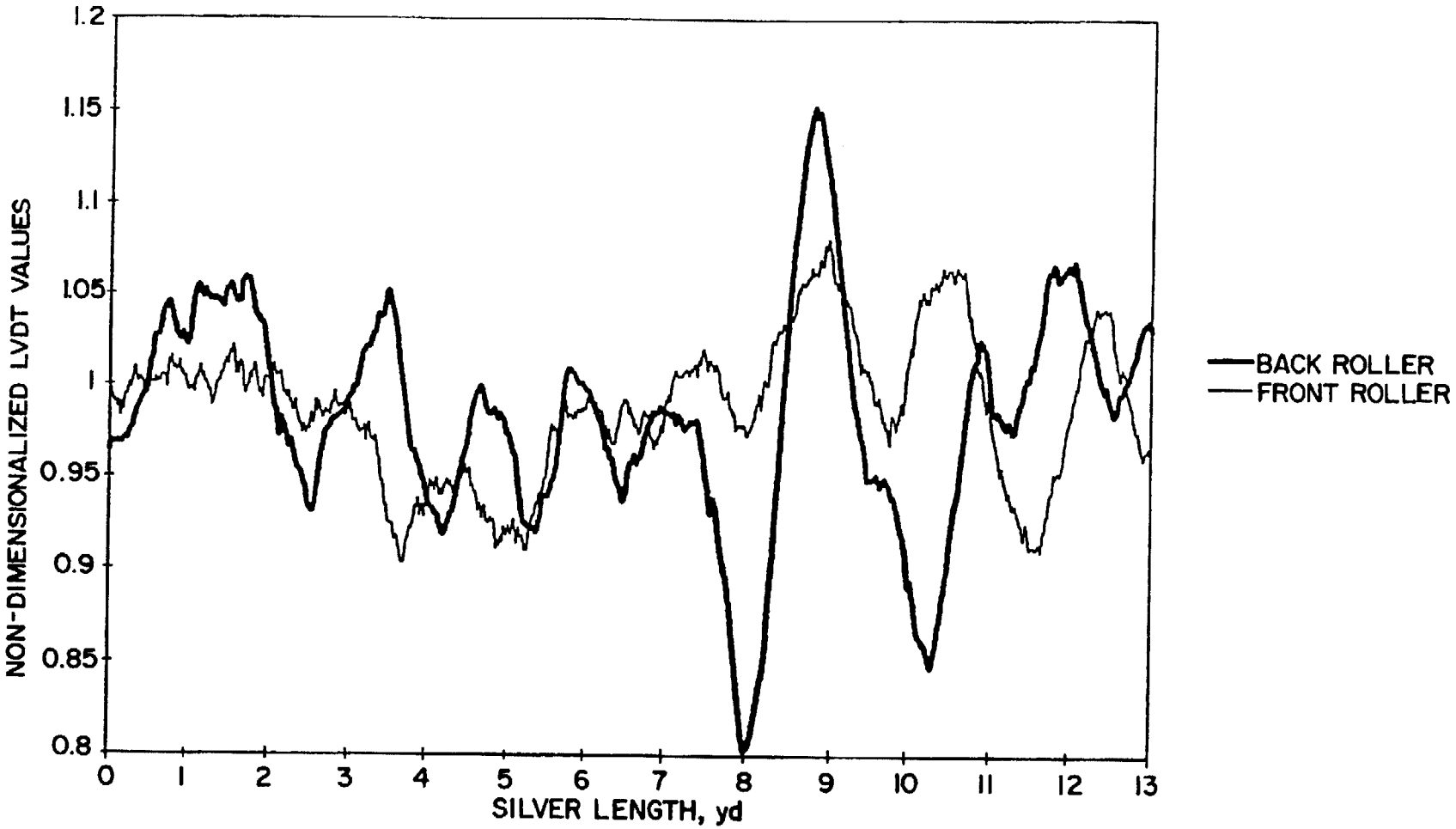

FIGS. 11A and 11B are graphical representations of the results of sliver autoleveling using the autoleveling system according to this invention wherein four (4) LVDTs are used as providing the input signals for the sliver autoleveling system. The graphs illustrated in FIGS. 11A and 11B show the signals coming from the LVDTs associated with vertical displacement of the upper roller of both the back roller pair and the front roller pair. The LVDT values for both the back upper roller and the front upper roller presented in the graph of FIG. 11A were taken at the same time, and therefore correspond to identical places along the sliver. Similarly, the LVDT values for both the back upper roller and the front upper roller presented in the graph of FIG. 11B were also taken at the same time, but at a different time from that at which the LVDT values for the graph of FIG. 11A was taken. The graphs of both FIGS. 11A and 11B show similar results, and it can be seen that the uniformity of the sliver leaving the drafting zone is much better than the uniformity of the sliver entering the drafting zone, clearly showing that there is much more variability of the thickness of the sliver prior to drafting than subsequent to drafting.

It is therefore seen that the present invention provides a novel sliver autoleveling system using tongue and groove drafting rollers as sliver uniformity sensing means. The LVDTs associated with the rollers facilitate sliver uniformity sensing by monitoring vertical displacement of the upper roller of each roller pair.

Figure 12:
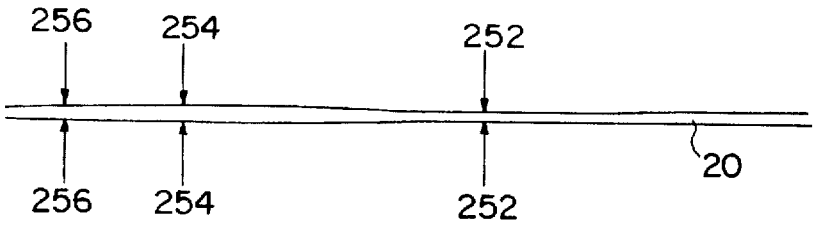
FIG. 12 is a horizontal sectional view of a textile fiber strand of sliver illustrating a thick portion, a thin portion, and an average thickness portion.

(4) Feed-Forward and Feed-Back Autoleveling System For Control of Sliver Drafting Rollers In accordance with the present invention, a novel feed-forward and feed-back autoleveling system for control of sliver drafting rollers, particularly the drafting ratio, is provided. An example of a length of sliver 20 is illustrated in FIG. 12 of the drawings and indicates for illustration purposes how a strand of sliver can have thin areas and thick portions. As shown, a thin portion of sliver 20 is indicated at arrow 252, and a thick portion of sliver 20 is indicated at arrow 254. Arrow 256 indicates a portion of average thickness or mass of sliver 20.

Figure 13A:
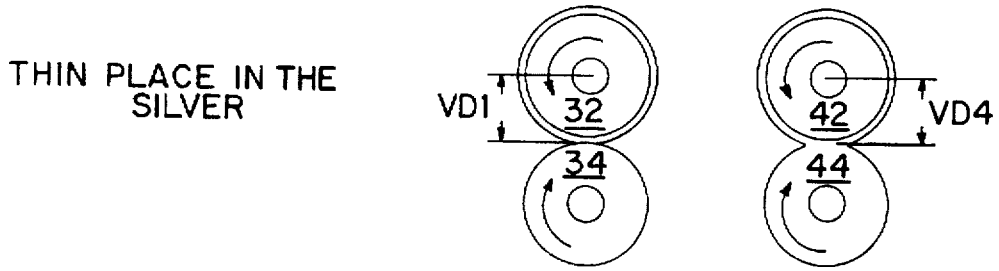
FIGS. 13A, 13B and 13C are schematic side views of the back and front rollers of a drafting system according to the present invention illustrating vertical displacement of the upper roll of each pair of rollers for sliver of various thicknesses.
Figure 13B:
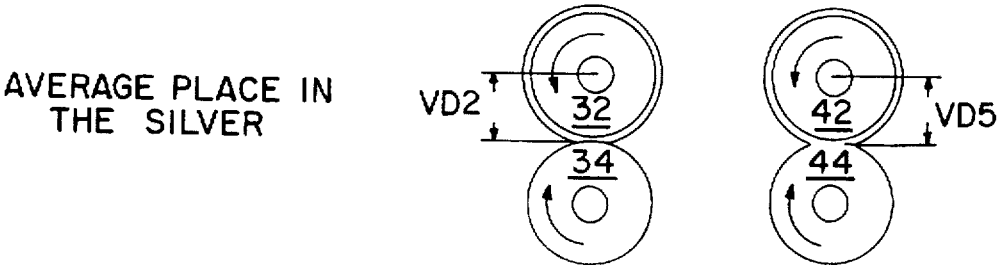
Figure 13C:
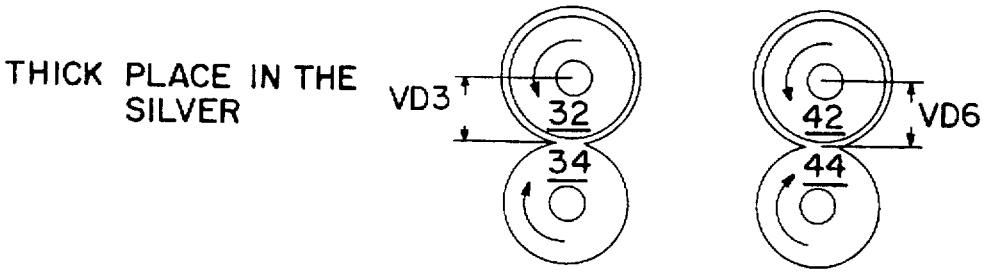

FIGS. 13A, 13B and 13C of the drawings each show schematic end views of both the back pair of rollers 30 and the front pair of rollers 40 and indicate, respectively, the action of the back rollers and the front rollers when a thin portion of sliver, a portion of average thickness of sliver, and a thick portion of sliver pass between each pair of rollers.

Referring to FIG. 13A, when a thin portion of sliver passes through the back rollers between back upper roller 32 and back lower roller 34, the vertical displacement of upper roller 32 is indicated as VD1, and VD1 will be less than the average vertical displacement passing between upper roller 32 and lower roller 34 during the drafting process. Such average vertical displacement results from an average portion of sliver passing between back upper roller 32 and lower roller 34 and is indicated as VD2 in FIG. 13B. Similarly, VD3 in FIG. 13C indicates the vertical displacement of back upper roller 32 as a thick portion of sliver passes between upper roller 32 and lower roller 34. As can be understood, VD3 will be greater than VD2 since there is more material passing between the back rollers. For each situation of the back rollers illustrated in FIGS. 13A, 13B and 13C, the velocity of the back rollers, such as upper roller 32 and lower roller 34, will preferably remain constant since the back rollers work in cooperation with the sliver delivery system which typically will deliver sliver at a constant speed.

As with the back rollers, the front rollers, such as front upper roller 42 and front lower roller 44, also have a vertical displacement of upper roller 42 away from lower roller 44 which can vary depending upon the thickness or mass of sliver passing therebetween. For a thin portion of sliver passing therebetween, VD4 indicates the vertical displacement of upper roller 42 as shown in FIG. 13A. FIG. 13B indicates VD5 which represents the vertical displacement of upper roller 42 when a portion of sliver of an average thickness passes between upper roller 42 and lower roller 44. Similarly, VD6 in FIG. 13C indicates the vertical displacement of upper roller 42 when a thick portion of sliver passes between the front rollers. Since the front rollers are the exit point for drafting in the autoleveling system, the vertical displacement of the front upper roller for sliver of various thicknesses should be much more uniform than that of the back rollers. Accordingly, it has been found that VD4, VD5, and VD6 are typically fairly close measurements to one another.

Unlike the back rollers, the velocity of the front rollers, such as upper roller 42 and lower roller 44, is variable depending upon the thickness or mass of sliver passing therebetween and the drafting that is desired. To promote uniformity of the sliver, the velocity of the front rollers when a thin portion of sliver passes therebetween will be less than the velocity of the front rollers when an average portion of sliver passes therebetween. Likewise, the velocity of the front rollers when an average portion of sliver passes therebetween will be less than the velocity of the front rollers when a thick portion of sliver passes therebetween.

According to the feed-forward autoleveling aspect of this invention, the thickness or mass of sliver 20 is sensed both prior to or during passing of the sliver through back rollers 30, and subsequent to or during passing of the sliver through front rollers 30. In other words, the sliver is initially sensed either prior to passing between back rollers 30, such as upper roller 32 and lower roller 34, or as the sliver actually passes therebetween. In one embodiment, the thickness or mass of sliver 20 can be sensed by the use of LVDTs working in association with back rollers 30 as described hereinabove as the sliver passes between the back rollers. It is envisioned, however, according to this invention, that other means could be utilized to sense the thickness or mass of the sliver either prior to passing between back rollers 30 or as the sliver passes therebetween. For example, an automatic monitoring device can be utilized for detecting the thickness or mass of the sliver prior to passing between back rollers 30. Such device (not shown) can be located at or used in combination with trumpet 22 used to deliver sliver to back rollers 30. Whichever sensor is used to initially sense the sliver, the initial sensor is referred to as the "input sliver sensor".

In addition to the input sliver sensor, an "output sliver sensor" is utilized according to the feed-back aspect of this invention to sense the thickness or mass of sliver 20 as it exits the drafting system or after it has exited the drafting system. In one embodiment, LVDTs 54 and 56 associated with front rollers 40 can be used as the output sliver sensor. It is envisioned, however, that other means can be utilized to sense sliver thickness or mass as it or after it passes through front rollers 40. For example, a sensor such as an USTER Sliver Data Sensor 72 (shown in FIG. 1), can be used after front rollers 40 and prior to packaging of the sliver.

Once the thickness or mass of sliver 20 is initially sensed, such information passes to and is processed by computer C, which in turn can control front rollers 40, such as upper roller 42 and lower roller 44, to cause them to rotate as necessary for a desired draft of the sliver. This process occurs automatically and without any delay in the autoleveling system taught herein. Back rollers 30 can be controlled as well, but corrective speed adjustments will more typically be made to the front rollers.

Although the preferred embodiment of the autoleveler includes both feed-forward and feed-back control, alternative embodiments can include only the feed-forward portion of the autoleveler or only the feed-back portion of the autoleveler. Either of these two (2) possible alternative embodiments is considered to be inferior to the combined feed-forward and feed-back embodiment in that a feed-forward system only would limit the ability of the system to monitor long-term changes, sliver weight and sliver weight uniformity. Therefore, it would impede the ability of the autoleveling system to guarantee long-term sliver mass weight uniformity. The feed-back system only would be far less able to respond to short-term fluctuations in sliver mass uniformity, and its ability to respond to short-term changes would be dependent upon how close the sensor was to the autoleveling drafting zone. If the sole sensor was on the output (front) rollers of the autoleveling drafting zone itself, then the system would be able to respond to relatively short-term fluctuations. As the sensor is positioned farther and farther away from the pair of output rollers, however, its ability to respond to short-term fluctuations will be reduced and therefore the resulting autoleveling system relying only on feed-back autoleveling would become more and more inferior. For a feed-back only autoleveling system it would therefore be desirable to have the sensor positioned as close as possible to or at the pair of output drafting rollers. For reasons which will be apparent to those of skill in the textile art, the preferred embodiment of the autoleveling system of this invention therefore comprises both feed-forward and feed-back aspects.

Figure 14:
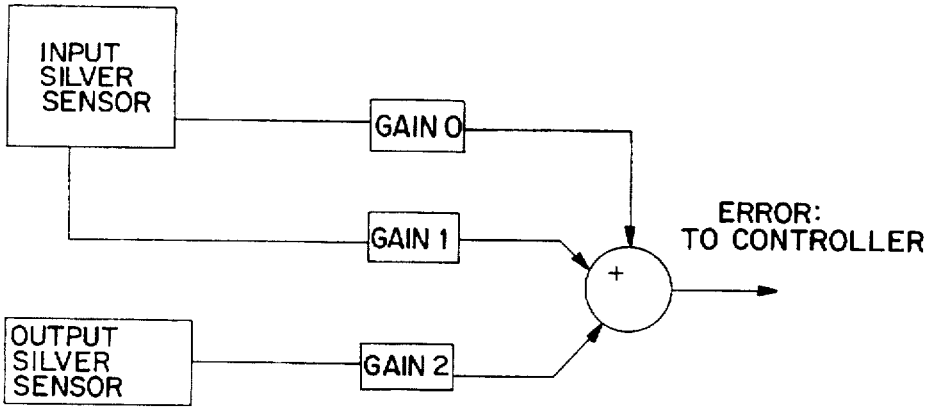
FIG. 14 is a schematic illustration of use of signals from the input and output sliver sensors according to the present invention.

The process of using the input and output sliver sensors for autoleveling is further illustrated in FIG. 14 of the drawings. As shown, the input sliver sensor signal is used in two different ways in the autoleveling system according to this invention. First, the signal from the input sliver sensor has a gain applied to it which is referred to as "Gain 0". Gain 0 represents the short-term, highly responsive, quick autoleveling that is performed on the sliver. Gain 0 is therefore utilized to make very quick changes regarding drafting of the sliver. Second, the signal from the input sliver sensor is also multiplied by a second gain corresponding to an intermediate term sliver autoleveling, and this is referred to as "Gain 1". Both Gain 0 and Gain 1 are used to make changes in drafting of the sliver forward of back rollers 30 without a delay. As described above, the output sliver sensor also produces a signal, and this signal is multiplied by a gain referred to as "Gain 2". Gain 2 is used to make long-term changes in drafting the sliver. Each of these three gains, Gain 0, Gain 1 , and Gain 2, can be used as described below to determine the error function which will be sent to computer C in order to determine the velocity at which front rollers 40 must be driven to achieve a desired draft. The input sliver sensor therefore enables the autoleveling system to make corrections in a feed-forward manner while the output sliver sensor enables the autoleveling system to make corrections in a feed-back manner.

The feed-forward and feed-back aspects of the control system of this invention therefore utilize information from the input sliver sensor and the output sliver sensor, respectively. Information from each sensor is entered into a computer algorithm that uses the information to create corrective information for system compensation.

Figure 15:
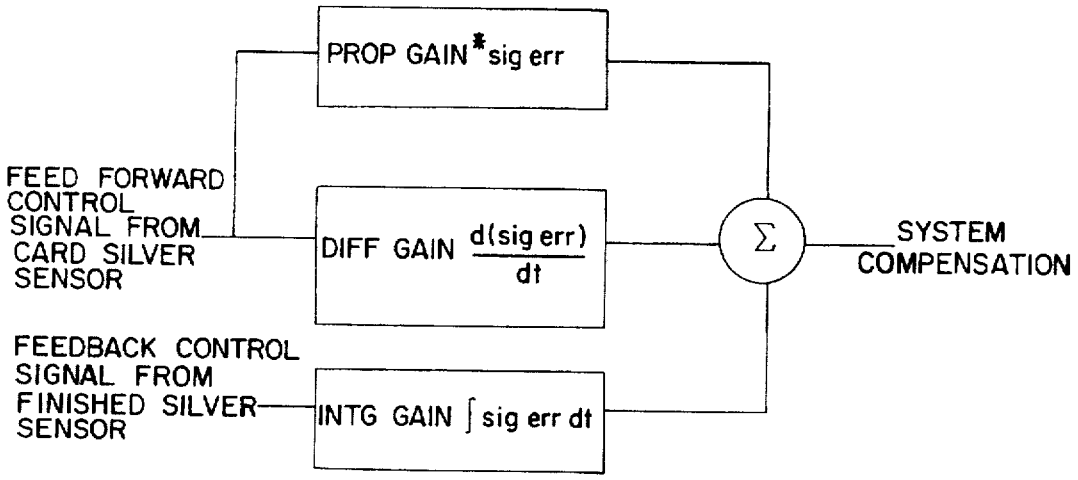
FIG. 15 is a schematic flow chart of the computer algorithm of the feed-forward and feed-back autoleveling system of the present invention.

Alternatively, referring now to FIG. 15, a digital filter and a numerical PID control system may be utilized for the feed-forward aspect of this invention. Signals from the input sliver sensor are digitized by the A/D card inside the computer. The DC bias of each signal is then subtracted to determine the signal error, which is then filtered using a low pass digital filter. The filtered error signal is then feed into the PID controller which determines the proper correction factor.

The feed-back aspect of the control system of this invention utilizes information from the output sliver sensor and preferably uses a numerical integrator. The computer algorithm integrates each filtered error signal of the output sliver sensor and maintains long term, preferably for approximately thirty (30) yards, the grain weight of the sliver.

Figure 16:
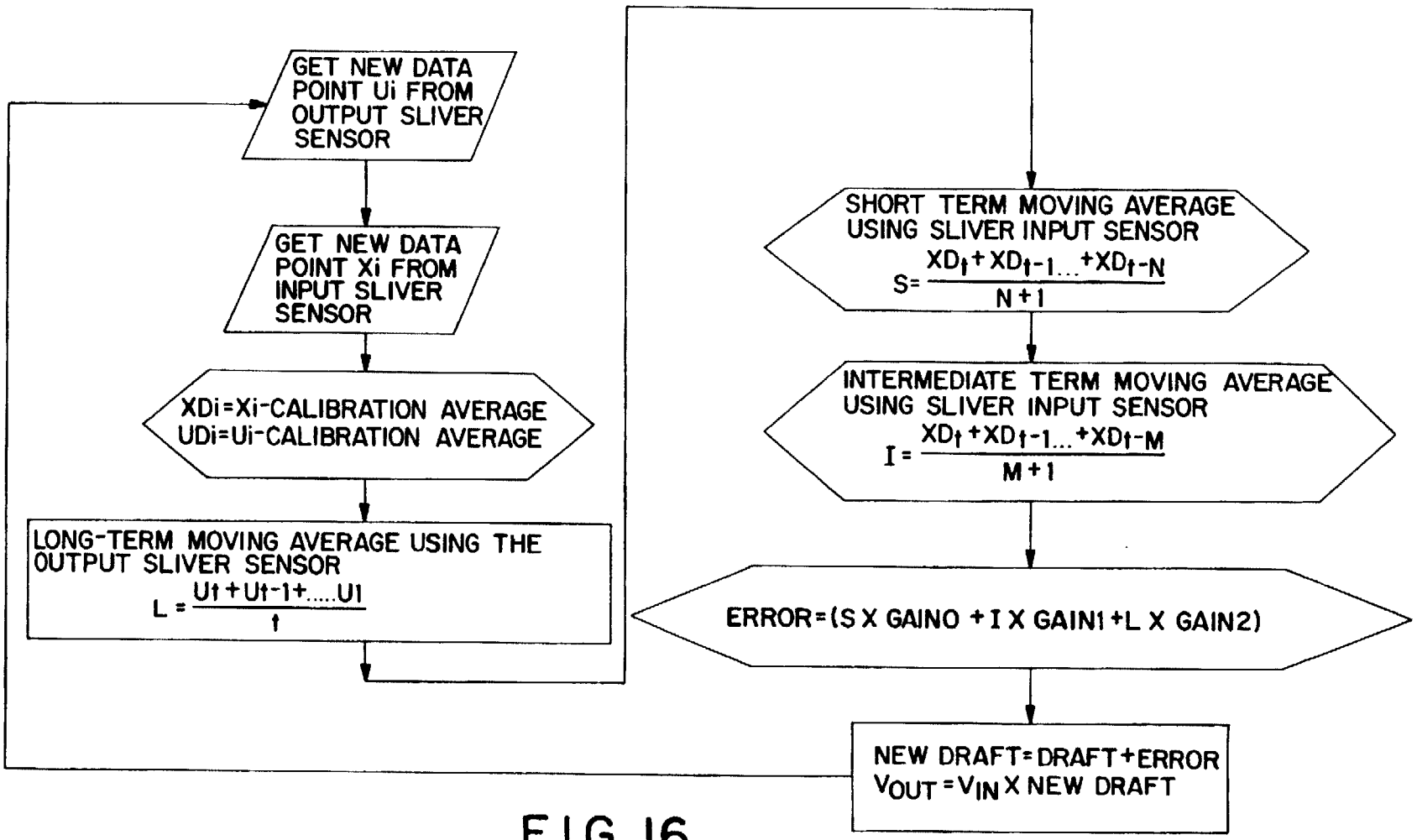
FIG. 16 is a flow chart illustrating the generation of information used to control drafting for correction of imperfections in sliver uniformity.

Describing the autoleveling system according to this invention in further detail with specific reference to the flow chart illustrated in FIG. 16 of the drawings, the initial step involves obtaining a plurality of data points from both the input sliver sensor and the output sliver sensor. In a preferred embodiment, it has been found that 8,192 data points from the input sliver sensor and the output sliver sensor are suitable. Using these data points, a calibration average is calculated for both the input sliver sensor and the output sliver sensor while delivering a sliver through the system of a predetermined average mass. After calibration, the autoleveling process can begin.

Digitized data from both the input and output sliver sensors are obtained one data point at a time during autoleveling. New data points from the input sliver sensor are designated "$X_i$", and new data points from the output sliver sensor are designated "$U_i$". Next, the difference between the new data point and the calibration average for each sensor is calculated, and these values are designated XDi for the input sliver sensor and UDi for the output sliver sensor. Recalling from the discussion regarding FIG. 14 hereinabove that data from the input sliver sensor is used in two different places, a short term moving average and an intermediate term moving average are both calculated from information provided by the input sliver sensor. For calculation of the short term moving average ("S"), a number of values indicating the difference between a given data point and the calibration average are added and the sum is averaged over the last few data points. A determination is then made according to value S as to the size of the average difference. Similarly, the intermediate moving average ("I") is calculated by adding an even greater number of values indicating the difference between a given point and the calibration average, and then averaging the sum to determine the intermediate average difference between the independent readings taken from the input sliver sensor and the calibration average known for the input sliver sensor.

Additionally, the long term moving average ("L") is calculated from information provided from the output sliver sensor by adding values indicating the differences of a certain number of data points and the calibration average over a predetermined period of time. Value L therefore represents the average difference between what the output sliver sensor has sensed over a period of time and what the average should have been.

Values S, I, and L are multiplied by gain 0, gain 1, and gain 2, respectively, and these products are added to determine the error function used to change the velocity of front rollers 40 as necessary for a desired draft ratio. The error function is preferably used to correctively adjust the velocity of front rollers 40 by adding the value of the error function to the value of the previous draft to get a new draft which is used to calculate the new velocity of front rollers 40. In this manner, it is possible to compensate for any irregularities in the sliver, and the velocity of front rollers 40 can be changed to provide more or less draft as needed so that a sliver of more uniform consistency emerges from the front rollers.

Figure 17A:
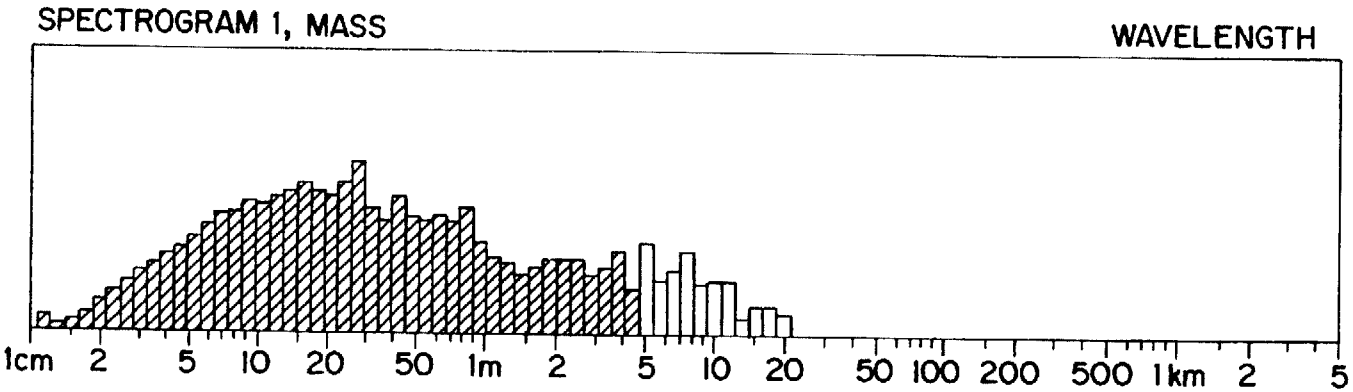
FIGS. 17A and 17B are spectrograms of carded sliver which has yet to pass through the drafting rollers of the drafting apparatus according to the present invention.
Figure 17B:
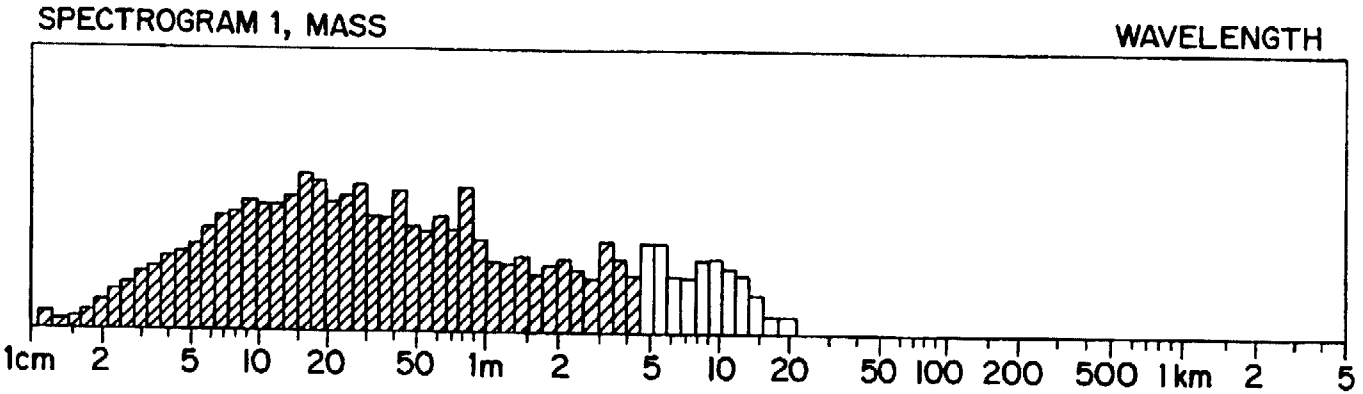
Figure 18A:
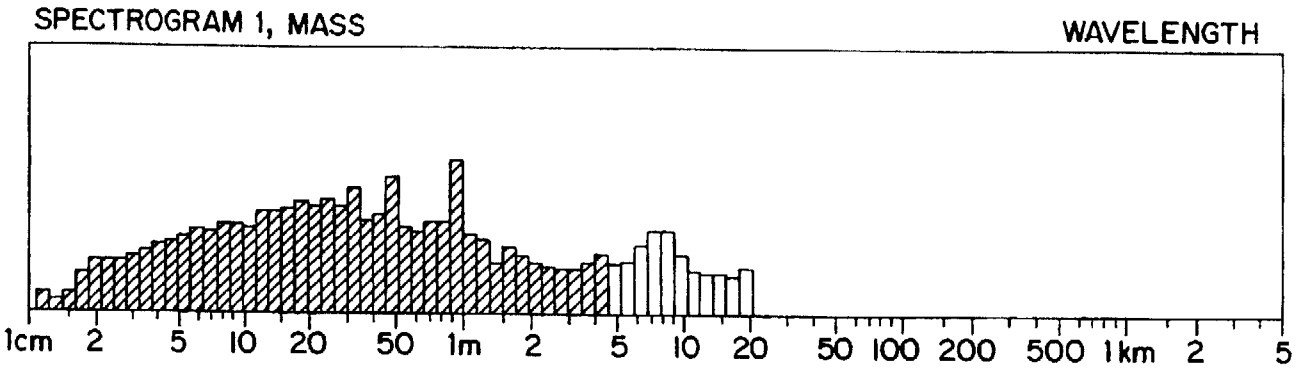
FIGS. 18A and 18B are spectrograms of sliver which has passed through the drafting rollers but without the autoleveling system functioning.
Figure 18B:
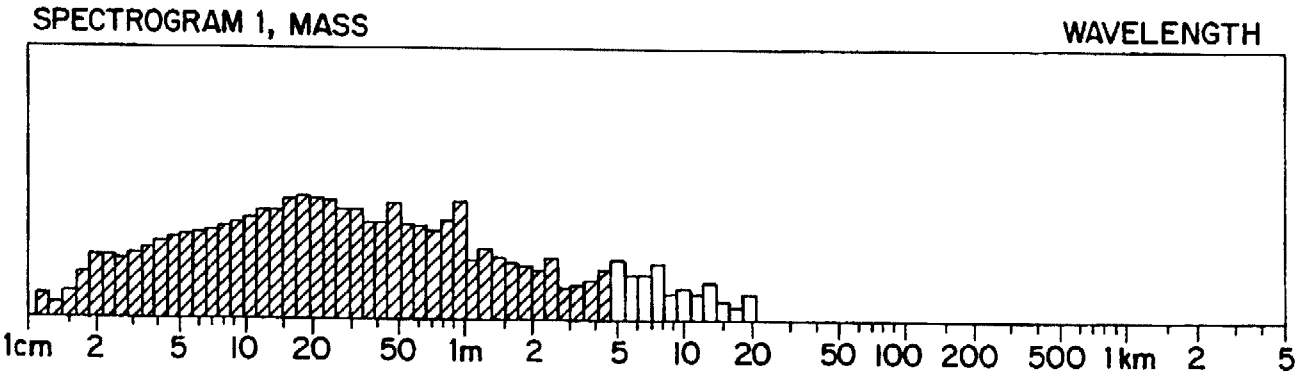
Figure 19A:
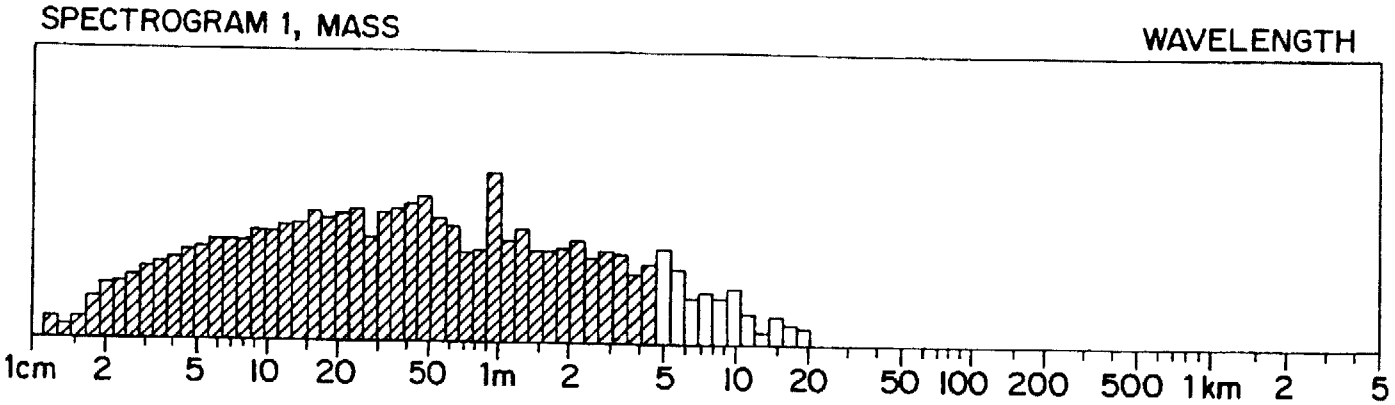
FIGS. 19A and 19B are spectrograms of sliver which has passed through the drafting rollers with the autoleveling system functioning with LVDTs used as sensors.
Figure 19B:
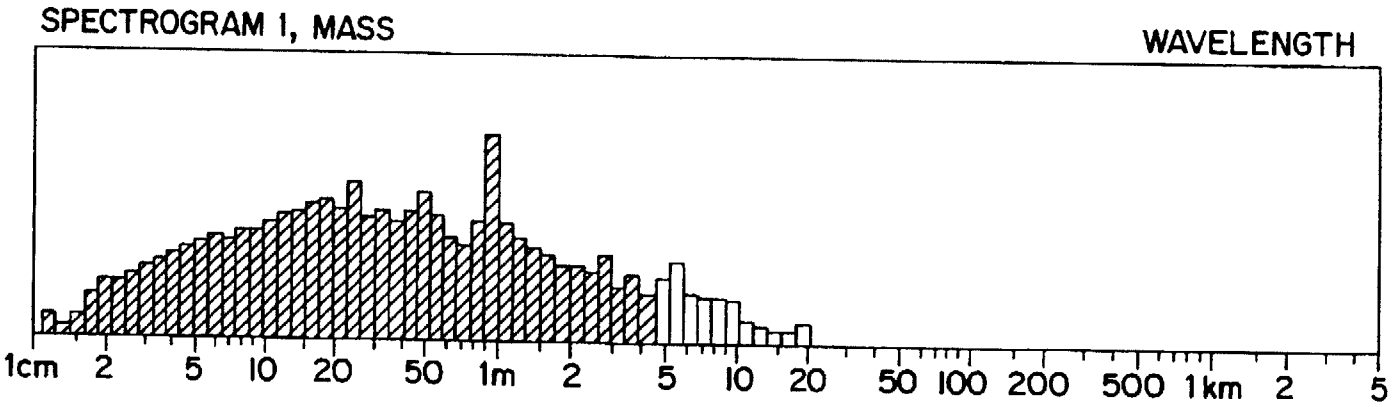
Figure 20A:
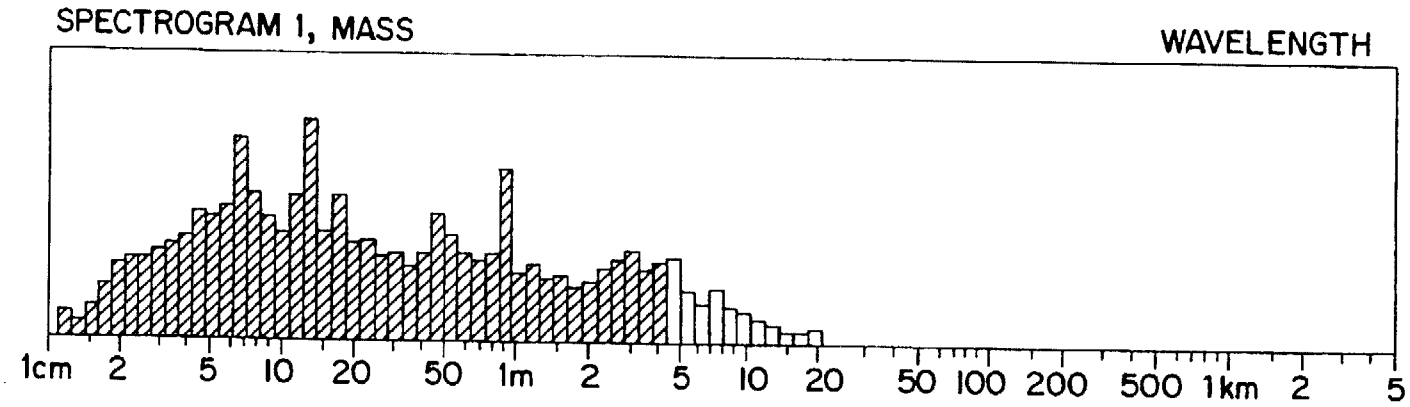
FIGS. 20A and 20B are spectrograms of sliver which has passed through the drafting rollers with the autoleveling system functioning with sensors other than LVDTs.
Figure 20B:
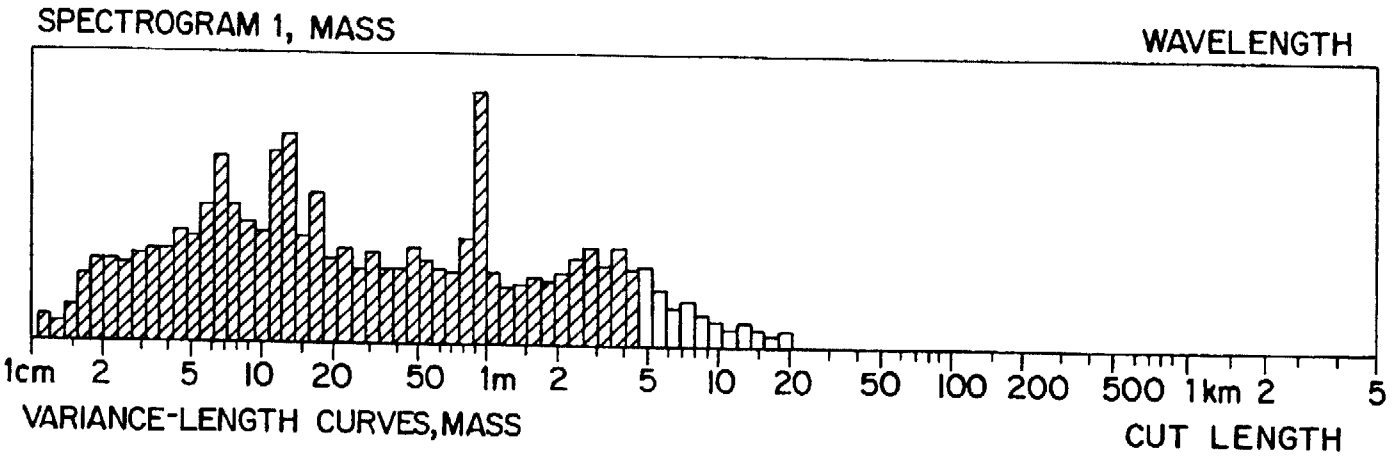

The efficacy of the autoleveling system provided by the present invention can be seen by comparing the various USTER spectrograms presented in FIGS. 17A, 17B, 18A, 18B, 19A, 19B, 20A and 20B. The spectrograms shown in FIGS. 17A and 17B are both spectrograms, each taken at a different time, for carded sliver, which is sliver actually fed into back rollers 30 of the autoleveling system. The spectrograms of FIGS. 17A and 17B therefore represent sliver which has yet to pass through the autoleveling system. The spectrograms presented in FIGS. 18A and 18B are both spectrograms, each taken at a different time, for sliver which has come from the card and passed through back and front rollers 30 and 40, respectively, of the drafting system without functioning of the autoleveling system as taught herein. FIGS. 19A and 19B present spectrograms, each taken at a different time, for sliver which has passed through back and front rollers 30 and 40, respectively, of the drafting system of the present invention during functioning of the autoleveling system as taught herein utilizing LVDTs as the input and output sensors. FIGS. 20A and 20B similarly present spectrograms of sliver, each taken at a different time, which is passed through back and front rollers 30 and 40, respectively, of the drafting system of the present invention during functioning of the autoleveling system, but with utilization of a sensor other than LVDTs. Instead, a trumpet sensor on the card itself was used as the input sliver sensor, and a trumpet sensor on the coiler was used as the output sliver sensor.

Standard coefficients of variation (CVs) for each spectrogram identified hereinabove which can be calculated by any conventional USTER measuring device are set forth in Table I hereinbelow and present both short term and one (1) meter CVs.

TABLE I

| Spectrogram | CVm (%) | CVm (1m) (%) |
|---|---|---|
| Figure 17A | 4.62 | 2.03 |
| Figure 17B | 4.89 | 2.38 |
| Figure 18A | 5.23 | 3.24 |
| Figure 18B | 4.82 | 2.94 |
| Figure 19A | 4.66 | 2.47 |
| Figure 19B | 4.62 | 1.94 |
| Figure 20A | 4.16 | 1.54 |
| Figure 20B | 3.90 | 1.59 |

Fiber Assembly: 70 gr/y
v = 50 m/min
t = 2.5 minutes
Tests: 1/1
Slot: 1/slivers
Yarn tension: 100%
Imperfections: short staple From a review of the spectrograms and corresponding CVs, the effect of the autoleveling system of the present invention can be seen. FIGS. 17A and 17B present similar data spectrograms, and as can be expected, the spectrograms and corresponding CVs show no visible improvement. The spectrograms of FIGS. 19A and 19B and the corresponding CVs show sliver after it has passed through the drafting system where the autoleveling system was functioning, and a comparison of such spectrograms and CVs with those of FIGS. 18A and 18B show improvement of the spectrograms and corresponding CVs. The sliver in the longer wavelengths, such as between five (5) and twenty (20) meters, particularly ten (10) meters, exhibits improved evenness. A comparison of the CVs also illustrates improvement in the short term and one (1) meter CVs. As can be seen from the spectrograms presented in FIGS. 20A and 20B, and corresponding CVs where sensors other than LVDTs were utilized as the sliver passed through the drafting system during functioning of the autoleveling, the sliver produced is improved over the sliver of FIGS. 18A and 18B and is a much more uniform product both in terms of short term CV and one (1) meter CV.

It is therefore seen that the present invention provides a novel feed-forward and feed-back autoleveling system for control of sliver drafting rollers, and it can be appreciated that this system can be utilized to automatically produce a sliver with a high degree of uniformity.

(5) Draftless Sliver Coiler Packaging System

In accordance with this invention, a novel draftless sliver coiler packaging system is provided. As discussed hereinabove, sliver 20 emerging from a drafting system is typically collected by a packaging device and often placed in a coiler can. In an autoleveling drafting system, the velocity of the sliver emerging therefrom by necessity will be changing very often, and accordingly, it is therefore desirable to utilize a sliver packaging system which can be adapted to the variations in velocity of the emerging sliver. It is also desirable to utilize a sliver packaging system wherein the sliver advances without drafting (so as to minimize non-uniformity) from a sliver delivery system to the location where the sliver is actually packaged.

Figure 21:
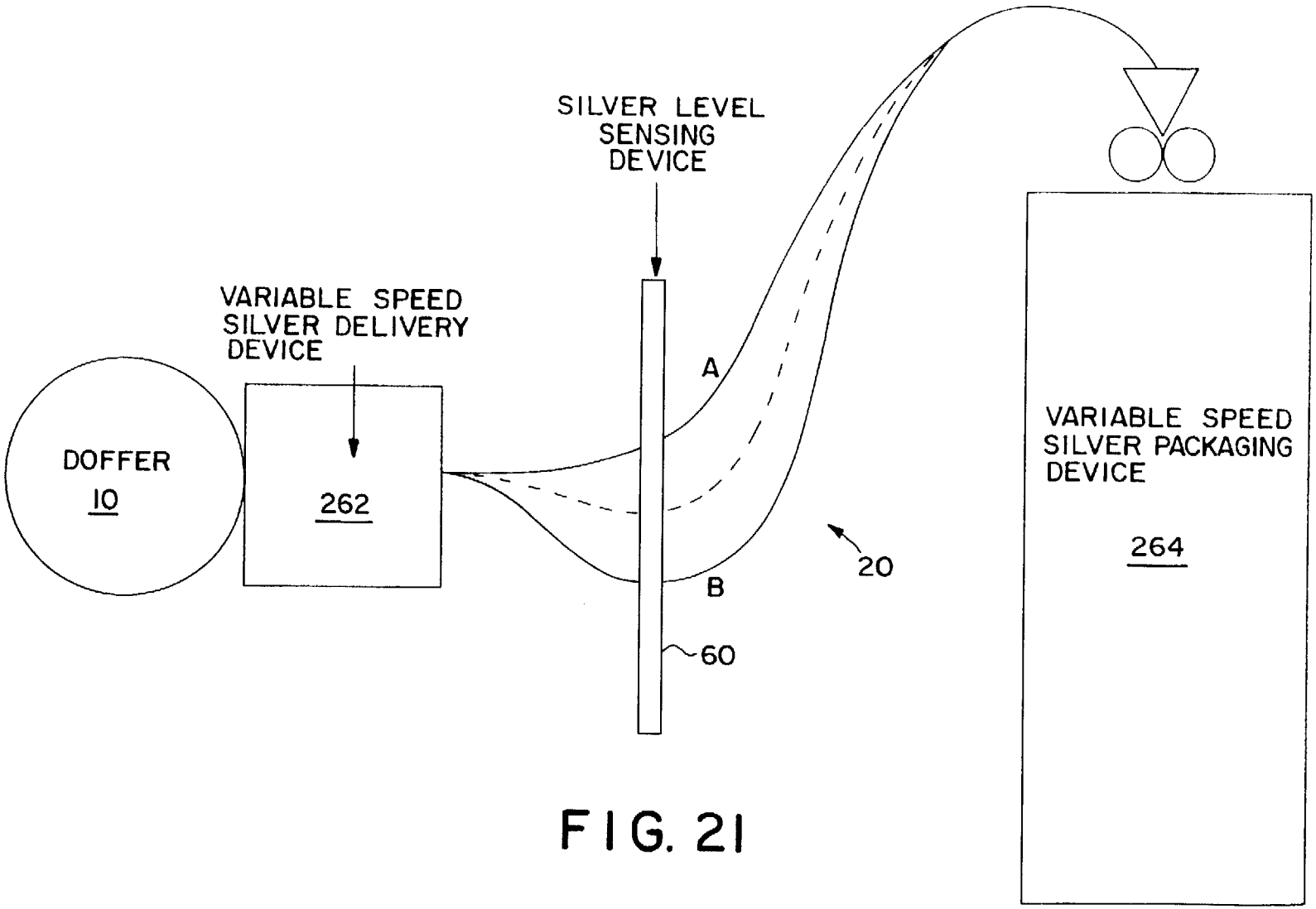
FIG. 21 is a schematic illustration of operation of the draftless sliver coiler packaging system according to the drafting system of the present invention.

As illustrated in FIG. 21, sliver 20, having been removed from a doffer roll, such as doffer roll 10, passes through a variable speed sliver delivery system 262, which can be the autoleveling system as taught and described herein. After sliver 20 passes through the variable speed sliver delivery system, it must then be collected.

Continuing to refer to FIG. 21, the draftless sliver coiler packaging system of the present invention comprises a sliver level sensor 60 for sensing in a non-contact manner the position or level of sliver 20. In the preferred embodiment, sliver level sensor 60 is adapted for sensing the vertical position of sliver 20. Sliver emerging from the variable speed sliver delivery system passes by sliver level sensor 60 and preferably then passes to a higher level prior to collection in a collecting device such as variable speed sliver packaging device 264 so that the sliver preferably forms an at least substantially untensioned loop between sliver level sensor 60 and variable speed sliver packaging device 264. When the speed of sliver emerging from variable speed sliver delivery system 262 increases, the size of the loop formed by sliver 20 between sliver level sensor 60 and variable speed sliver packaging device 264 will increase. Similarly, when the speed of the sliver emerging from variable speed sliver delivery system 262 decreases, the size of the loop formed by sliver 20 between sliver level sensor 60 and variable speed sliver packaging device 264 will decrease. As an example, sliver 20 illustrated in FIG. 21 moving from position A to position B shows the size of the loop of sliver increasing (and the sliver dropping lower) and indicates that the delivery speed of sliver 20 emerging from variable speed sliver delivery system 262 is increasing.

Figure 22:
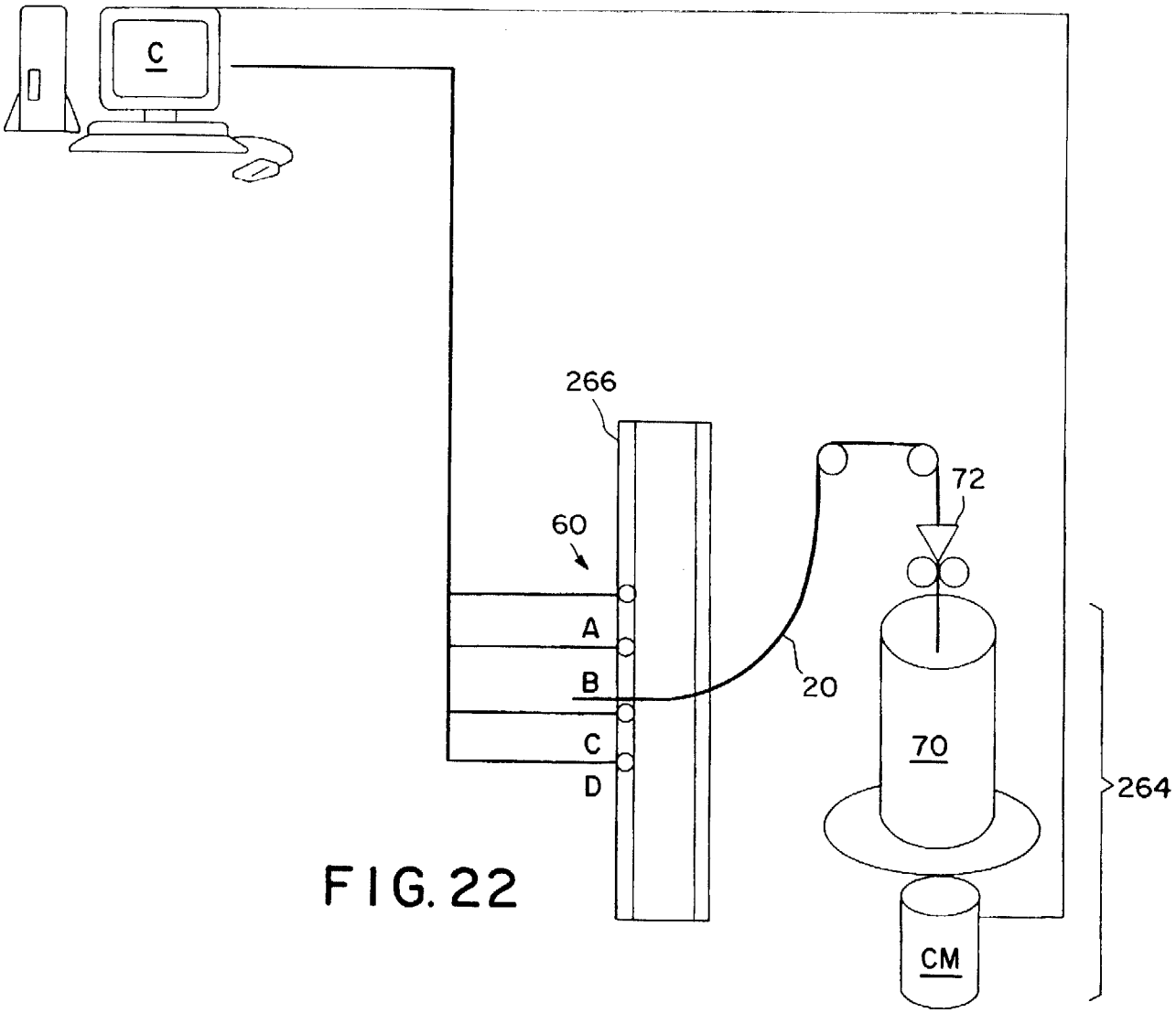
FIG. 22 is a schematic illustration showing greater details of operation of the draftless sliver coiler packaging system according to the drafting system of the present invention.

In the preferred embodiment, the sliver level sensor according to this invention comprises a plurality of photodiodes, such as for example, photodiodes A, B, C and D as illustrated in FIG. 22. Of course, other sliver level sensors such as proximity sensors and the like can be utilized. The photodiodes can be photoelectric sensors, such as the TELEMECANIQUE brand, Model Number XUP-J20313S, 12—12 V, 200 mA. The photodiodes are preferably in a spaced-apart vertical alignment and can be in a frame 266 such that the position of sliver 20 passing through or by the photodiodes can be sensed. It is envisioned according to this invention that any suitable number of photodiodes could be utilized as well as any suitable alignment thereof in order to sense the vertical position of sliver 20.

The photodiodes can be adjusted such that the position of the sliver is between a predetermined pair of photodiodes during normal operating conditions. For example, the normal operating position for sliver 20 can be between photodiodes B and C shown in FIG. 22. When the speed of sliver emerging from the variable speed sliver delivery system increases, the size of the sliver loop increases and the loop will fall below the level of photodiode C. When this occurs, photodiode C is triggered, and a signal is sent to computer C, which will send a control signal to the device utilized for sliver packaging causing it to increase the speed at which the sliver is packaged.

As shown in FIG. 22, the sliver packaging system according to this invention comprises a coiler can 70 having a coiler motor CM operatively connected thereto for collecting sliver. If the variable speed sliver delivery system 262 continues to increase the speed at which sliver emerges therefrom, the size of the sliver loop will continue to grow and pass below additional photodiodes, such as photodiode D. When this occurs, photodiode D sends a signal to computer C, and computer C in turn sends a control signal to coiler motor CM causing the speed at which sliver 20 is collected is increased even further. As can be understood, when the variable speed sliver delivery system 262 decreases the speed at which sliver emerges therefrom, the size of the sliver loop will accordingly decrease. This decrease in velocity of the emerging sliver can thereby cause the sliver to rise with respect to the photodiodes. As this occurs, successive levels of photodiodes can be triggered and cause computer C to cause coiler motor CM to decrease the speed at which sliver is packaged.

If the sliver loop gets too short, the sliver can break. On the other hand, if the sliver loop gets too long, the sliver falls and can accumulate on the floor. The sliver coiler packaging system as described herein prevents the sliver loop from becoming too short or too long by providing a high degree of automatic control of sliver packaging in an advantageously draftless manner.

It is therefore seen that a novel draftless sliver coiler packaging system is provided. In the sliver packaging system according to this invention, there is no induced tension in the sliver or drafting of the sliver between the sliver delivery system and the location where the sliver is packaged. Additionally, there is no mechanical linkage between the sliver delivery system and the sliver packaging device, and there is no mechanical contact with the sliver therebetween. As will be apparent to those of skill in the textile art, the draftless sliver coiler packaging system as taught herein is therefore of great value in association with a variable speed sliver delivery system (such as an autoleveling sliver drafting system) to produce highly uniform sliver.

It is therefore seen that the present invention provides a novel automated drafting system for textile strands which imparts a high degree of uniformity to a textile strand during the drafting process. It is also seen that the present invention provides a novel synchronous drive sliver drafting roller system, a novel system for securing and pressuring together upper and lower sliver drafting rollers, a novel sliver autoleveling system using tongue and groove drafting rollers as sliver uniformity sensing means, a novel feed-forward and feedback autoleveling system for control of sliver drafting rollers, and a novel draftless sliver coiler packaging system. Although these innovations could each be used independently of the others, applicants contemplate that the integrated use of all five innovations provides for the best possible enhancement of sliver drafting performance.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A textile drafting apparatus adapted for securing and urging together at least one pair of drafting rollers used in drafting a strand of textile material passing therebetween, said apparatus comprising:

(a) a first frame supporting and maintaining a first roller of said at least one pair of drafting rollers in a substantially fixed position allowing rotational movement thereof;

(b) a second frame supporting a second roller of said at least one pair of drafting rollers and movably cooperating with said first frame such that said first and second rollers are substantially parallel and can cooperatively draft a strand of textile material passing therebetween when said rollers are in an operative drafting position; and (c) pneumatic adjustment means connected to said second frame for selectively moving said second frame along a direction toward and away from said first frame whereby said second roller can be moved toward and into operative engagement and away and into inoperative engagement with said first roller, and wherein at least a portion of said second frame is receivable within at least a portion of said first frame to restrict movement of said second frame in a direction perpendicular to movement allowed by said pneumatic adjustment means.

2. The apparatus of claim 1 wherein said first frame comprises opposing plates defining a slot in which a portion of said second frame is receivable.

3. A textile drafting apparatus adapted for securing and urging together at least one pair of drafting rollers used in drafting a strand of textile material passing therebetween, said apparatus comprising:

(a) a first frame supporting and maintaining a first roller of said at least one pair of drafting rollers in a substantially fixed position allowing rotational movement thereof;

(b) a second frame supporting a second roller of said at least one pair of drafting rollers and movably cooperating with said first frame such that said first and second rollers are substantially parallel and can cooperatively draft a strand of textile material passing therebetween when said rollers are in an operative drafting position, and wherein an upper portion of said second frame including said second roller is slidably removable from a bottom portion of said second frame; and (c) pneumatic adjustment means connected to said second frame for selectively moving said second frame along a direction toward and away from said first frame whereby said second roller can be moved toward and into operative engagement and away and into inoperative engagement with said first roller.

4. The apparatus of claim 3 wherein said upper portion of said second frame defines a plurality of appendages and the bottom portion of said second frame defines a plurality of slots adapted for slidably receiving said appendages.

5. A textile drafting apparatus adapted for securing and urging together at least one pair of drafting rollers used in drafting a strand of textile material passing therebetween, said apparatus comprising:

(a) a first frame supporting and maintaining a first roller of said at least one pair of drafting rollers in a substantially fixed position allowing rotational movement thereof;

(b) a second frame supporting a second roller of said at least one pair of drafting rollers and movably cooperating with said first frame such that said first and second rollers are substantially parallel and can cooperatively draft a strand of textile material passing therebetween when said rollers are in an operative drafting position, and wherein at least a portion of said second frame is receivable within at least a portion of said first frame to restrict movement of said second frame in a horizontal direction; and (c) pneumatic adjustment means connected to said second frame for selectively moving said second frame along a direction toward and away from said first frame whereby said second roller can be moved toward and into operative engagement and away and into inoperative engagement with said first roller, and wherein said first roller is a lower roller and said second roller is an upper roller and wherein said pneumatic adjustment means provides only vertical movement of said second frame and roller toward and away from said first frame and roller.

6. A textile drafting apparatus adapted for securing and urging together at least one pair of drafting rollers used in drafting a strand of textile material passing therebetween, said apparatus comprising:

(a) a first frame supporting and maintaining a first roller of said at least one pair of drafting rollers in a substantially fixed position allowing rotational movement thereof;

(b) a second frame supporting a second roller of said at least one pair of drafting rollers, and wherein an upper portion of said second frame including said second roller is removable by slidable movement thereof in a horizontal direction substantially perpendicular to said vertical direction; and (c) pneumatic adjustment means for selectively vertically moving said second frame between an inoperative extended position wherein said first and second rollers are spaced-apart and an operative retracted position wherein said first and second rollers are urged cooperatively together to facilitate drafting of a strand of textile material passing therebetween.

7. The apparatus of claim 6 wherein slidable movement of said upper portion is prevented when said second frame is in its operative retracted position.

* * * * *